US007652652B2

(12) United States Patent
Maeda et al.

(10) Patent No.: US 7,652,652 B2
(45) Date of Patent: Jan. 26, 2010

(54) DATA SIGNAL LINE DRIVING METHOD, DATA SIGNAL LINE DRIVING CIRCUIT, AND DISPLAY DEVICE USING THE SAME

(75) Inventors: Kazuhiro Maeda, Nara (JP); Sachio Tsujino, Yao (JP); Hajime Washio, Sakurai (JP); Yuhji Asoh, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 904 days.

(21) Appl. No.: 10/705,775

(22) Filed: Nov. 12, 2003

(65) Prior Publication Data

US 2004/0130520 A1 Jul. 8, 2004

(30) Foreign Application Priority Data

Nov. 12, 2002 (JP) ..... 2002-328835

(51) Int. Cl.
*G09G 3/36* (2006.01)

(52) U.S. Cl. ..... 345/100; 345/98; 345/99; 345/205

(58) Field of Classification Search ..... 345/100, 345/98, 99, 205
See application file for complete search history.

(56) References Cited

U.S. PATENT DOCUMENTS

| | | | | |
|---|---|---|---|---|
| 5,781,171 | A * | 7/1998 | Kihara et al. | 345/93 |
| 6,219,023 | B1 | 4/2001 | Kim | |
| 6,229,513 | B1 * | 5/2001 | Nakano et al. | 345/99 |
| 6,507,332 | B1 | 1/2003 | Kuwabara et al. | |
| 2002/0057251 | A1 * | 5/2002 | Higashi | 345/100 |
| 2002/0075209 | A1 | 6/2002 | Shigeta | |
| 2003/0112230 | A1 | 6/2003 | Maeda et al. | |
| 2003/0174117 | A1 * | 9/2003 | Crossland et al. | 345/100 |

FOREIGN PATENT DOCUMENTS

| | | | |
|---|---|---|---|
| EP | 0 803 855 | A2 | 10/1997 |
| EP | 0821338 | A2 * | 1/1998 |

(Continued)

OTHER PUBLICATIONS

Chinese Office Action and English translation thereof mailed Jun. 3, 2005 in corresponding Chinese application No. 200310114317.X.

*Primary Examiner*—Amare Mengistu
*Assistant Examiner*—Robert R Rainey
(74) *Attorney, Agent, or Firm*—Nixon & Vanderhye PC

(57) ABSTRACT

The data signal line driving circuit of the present invention is arranged so that data signal line groups, each of which is made up of two data signal lines sequentially disposed, are connected to two video signal lines, each of which allows a two-phased video signal to be forwarded. A shift register SR, a drive switching circuit, and a waveform shaping circuit, that constitute a video signal fetching section, collect the data signal line groups via the two video signal lines as a single block. At this time, the data signal lines are respectively driven so as to fetch the video signal from the video signal lines into the data signal lines of the data signal line groups in each block. Thus, in performing multiphase development, it is possible to provide the data signal line driving circuit which can reduce power consumption in low resolution driving compared with a case of high resolution driving.

10 Claims, 26 Drawing Sheets

FOREIGN PATENT DOCUMENTS

| | | | | |
|---|---|---|---|---|
| JP | 05-303362 | | | 11/1993 |
| JP | 09-258164 | | | 10/1997 |
| JP | 10-031461 | | | 2/1998 |
| JP | 11-065530 | | | 3/1999 |
| JP | 11-143380 | | | 5/1999 |
| JP | 2000-181394 | A | | 6/2000 |
| JP | 2000-181394 | A | * | 6/2000 |
| JP | 2000-181414 | | | 6/2000 |

* cited by examiner

PRIOR ART

PRIOR ART

FIG. 26

TABLE 1

| | HIGH RESOLUTION | | LOW RESOLUTION | | |
|---|---|---|---|---|---|
| ARRANGEMENT | NUMBER OF PHASE DEVELOPMENTS | DOT FREQUENCY RATIO | NUMBER OF PHASE DEVELOPMENTS | DOT FREQUENCY RATIO | POWER CONSUMPTION RATIO※ |
| FIG. 1 | 2 | 1 | 2 | 1/2 | LARGE |
| FIG. 13 | 2 | 1 | 2 | 1／2(1) | MIDDLE(1) |
| FIG. 22 | 2 | 1 | 1 | 1 | 1 |

※(HIGH RESOLUTION POWER CONSUMPTION)/(LOW RESOLUTION POWER CONSUMPTION)

DATA SIGNAL LINE DRIVING METHOD, DATA SIGNAL LINE DRIVING CIRCUIT, AND DISPLAY DEVICE USING THE SAME

This Nonprovisional application claims priority under 35 U.S.C. § 119(a) on Patent Application No. 2002/328835 filed in Japan on Nov. 12, 2002, the entire contents of which are hereby incorporated by reference.

FIELD OF THE INVENTION

The present invention relates to a data signal line driving method, a data signal line driving circuit, and a display device using the same, in which a multiphased video signal is fetched into data signal lines and the data signal lines are driven so as to output the fetched video signal.

BACKGROUND OF THE INVENTION

Generally, as shown in FIG. 21, an image display device such as a liquid crystal panel and an organic EL (Electroluminescence) panel includes: data signal lines SL1 to SLx; scanning signal lines GL1 to GLy which cross the data signal lines SL1 to SLx at a right angle; a pixel array PIXARRAY having pixels PIX disposed on intersections of the data signal lines and the scanning signal lines; a data signal line driving circuit SD for driving the data signal lines; a scanning signal line driving circuit GD for driving the scanning signal lines; and a control signal generating section for supplying a control signal to the data signal line driving circuit SD and the scanning signal line driving circuit GD.

The data signal line driving circuit SD, the scanning signal line driving circuit GD, the control signal generating section, and the pixel array PIXARRAY are integrally formed on an insulating substrate made of material such as glass, quartz, and the like. In this case, each of the driving circuits is constituted of a thin film MOS transistor made of poysilicon (hereinafter, referred to as a polysilicon TFT).

Incidentally, a driving circuit using a polysilicon TFT has such disadvantage that its operation speed is much slower than that of a driving circuit using a monocrystal silicon TFT. Particularly, in a case of realizing large-screen and large-volumetric display by using the data signal line driving circuit for driving the data signal lines, a shift resister which constitutes the data signal line driving circuit operates too slowly. Thus, various methods are studied to drive the data signal line within the operation speed of the shift resister constituted of the polysilicon TFT.

For example, there is proposed the following multiphase development technique: in the data signal line driving circuit, a plurality of video signal lines are provided, and a multiphased video signal DAT is inputted to the video signal lines, and the video signal inputted to one video signal and the video signal inputted to another video signal line are simultaneously outputted from the data signal lines connected to the video signal lines, thereby dropping a frequency of the shift resister as the video signal is further multiphased.

FIG. 22 is a block diagram schematically showing the data signal line driving circuit in a case where a video signal is two-phased. In this example, the video signal DAT is divided into two video signals: a video signal DAT1 and a video signal DAT2, and the video signals DAT1 and DAT2 are outputted from the data signal lines via the respective video signal lines. In this case, as shown in FIG. 23, two data signal lines SL are driven at the same timing by a single shift resister SR and a single waveform shaping circuit SMP (see a timing chart shown in FIG. 24).

Note that, FIG. 22 illustrates (i) two video signal lines and (ii) a single shift resister corresponding to the two video signal lines, so as to simplify the illustration, but a technique, based on the same technical idea, which has eight video signal lines and four shift resisters corresponding to the four video signal lines, is disclosed in Patent Document 1 (U.S. Pat. No. 6,219,023 B1) for example.

As described above, when the data signal line driving circuit is driven in accordance with two-phase development, it is possible to slow an operation speed (frequency) of a shift resister constituting the data signal line driving circuit.

Note that, FIG. 24 is a timing chart showing a case where it is assumed that resolution of the pixel PIXARRAY which functions as a display section is the same as resolution of the inputted video signal.

However, in the foregoing display device, it is required that the resolution of the display section is the same as the resolution of the video signal, and it is also required to input the video signal whose resolution is less than the resolution of the display section so as to display an image. For example, in order to display an image appropriately in inputting the video signal whose resolution is half of the resolution of the display section, the data signal line driving circuit is operated in accordance with the timing chart shown in FIG. 25. That is, by causing two data signal lines to output the same video signal, it is possible to display the video signal whose resolution is half of the resolution of the display section. Note that, at this time, also in the scanning line driving circuit, every two scanning signal lines are driven.

Incidentally, in a conventional data signal line driving circuit which performs multiphase development, the data signal lines adjacent to each other are respectively connected to the video signal lines different from each other. For example, in a case of a data signal line driving circuit shown in FIG. 22, two data signal lines adjacent to each other are respectively connected to the video signal lines DAT1 and DAT2. Moreover, the two data signal lines adjacent to each other are connected to the same shift resister SR via the same waveform shaping circuit SMP.

Thus, when displaying the video signal whose resolution is the same as the resolution of the display section (high resolution driving), as shown in FIG. 24, the video signals from the two video signal lines are outputted to the data signal line in synchronism with a timing pulse from the shift resister, so that the development is performed in accordance with two-phase development. Thus, it is possible to make the frequency of the shift resister half of the frequency in the case where the phase development is not performed while keeping the frequency of the video signal as it is. As a result, it is possible to obtain such advantage that power consumption of the data signal line driving circuit can be reduced compared with the case where the phase development is not performed.

However, when displaying the video signal whose resolution is lower than the resolution of the display section (low resolution driving), as shown in FIG. 25, the same video signal is supplied to the data signal lines adjacent to each other, so that it is necessary to supply the same video signal to the two video signal lines. Thus, in performing the low resolution driving, the phase development is not performed unlike the high resolution driving.

In this manner, when the low resolution driving is performed, as described above, it is necessary to supply the same data to the two video signal lines, so that the frequency of the shift resister of the data signal line driving circuit shown in FIG. 22 is the same as the frequency in the case where the high resolution driving is performed, but the frequency of the video signal supplied from the video signal line is also the same as the frequency in the case where the high resolution driving is performed. As a result, the power consumption etc. in the data signal line driving circuit is equal to the power consumption etc. in the case where the high resolution driving is performed. As a result, the power consumption of the data signal line driving circuit in performing the low resolution driving is equal to the power consumption of the data signal line driving circuit in performing the high resolution driving.

Thus, in the conventional data signal line driving circuit which performs the multiphase development, the power consumption etc. in the case where the high resolution driving is equal to the power consumption etc. in the case where the low resolution driving is performed, so that this raises such problem that the power consumption is not reduced even when the resolution is lowered.

SUMMARY OF THE INVENTION

The object of the present invention is to provide a data signal line driving method, a data signal line driving circuit, and a display device having the same, by which it is possible to reduce the power consumption in the low resolution driving, compared with the case of the high resolution driving, in performing the multiphase development.

In order to achieve the foregoing object, the data signal line driving method according to the present invention, whereby driving a plurality of data signal lines respectively so as to fetch a multiphased video signal via a plurality of video signal lines into the data signal lines, includes the steps of: gathering data signal line groups, each made up of a predetermined number of the data signal lines sequentially connected to each of the video signal lines, whose number is the same as the number of the video signal lines, said data signal line groups being regarded as a single block; and fetching the video signal from the video signal lines into the data signal lines in each block.

According to the arrangement, the video signal is fetched from the video signal lines into the data signal lines in each block, so that the video signal is fetched from the video signal lines, different from each other, into the data signal line groups.

Thus, even if each data signal line of one of the data signal line groups in each block is driven at the same timing as a timing at which each data signal line of another one of the data signal line groups in each block (high resolution driving), or even if all the data signal lines of the data signal line groups are driven at the same timing (low resolution driving), it is possible to forward video signals different from each other to the video signal lines (multiphase development), so that it is possible to suppress the power consumption in the low resolution driving compared with the case of the high resolution driving.

Further, in the case where the video signal contains a plurality of color signals, it is possible to carry out the following data signal line driving method.

That is, it may be so arranged that: the data signal line driving method, whereby driving a plurality of data signal lines respectively so as to (i) multiphase a video signal having a plurality of color signals and (ii) fetch the video signal into the data signal lines, said method includes the steps of: causing a plurality of divisional video signal lines, divided so as to respectively correspond to the color signals, to constitute each of the video signal lines; gathering data signal line groups, each made up of a predetermined number of the data signal lines sequentially connected to each of the divisional video signal lines so as to respectively correspond to the color signals, whose number is the same as the number of the video signal lines, said data signal line group being regarded as a single block; and fetching the video signal from the video signal lines into the data signal lines in each block.

Also in this case, it is possible to forward video signals different from each other to the video signal lines (multiphase development), so that it is possible to suppress the power consumption in the low resolution driving compared with the case of the high resolution driving.

Further, the data signal line driving circuit according to the present invention, which drives a plurality of data signal lines respectively so as to fetch a multiphased video signal via a plurality of video signal lines into the data signal lines, includes: data signal line groups, each made up of a predetermined number of the data signal lines sequentially connected to each of the video signal lines; and a video signal fetching section for fetching the video signal from the video signal lines into the data signal lines in each block when gathering data signal line groups, each made up of a predetermined number of the data signal lines sequentially connected to each of the video signal lines, whose number is the same as the number of the video signal lines, said data signal line groups being regarded as a single block.

According to the arrangement, the video signal fetching section fetches the video signal from the video signal lines into the data signal lines in each block, so that the video signal is fetched from the video signal lines, different from each other, into the data signal line groups.

Thus, even if each data signal line of one of the data signal line groups in each block is driven at the same timing as a timing at which each data signal line of another one of the data signal line groups in each block, or even if all the data signal lines of the data signal line groups are driven at the same time, it is possible to forward video signals different from each other to the video signal lines (multiphase development), so that it is possible to suppress the power consumption in the low resolution driving compared with the case of the high resolution driving.

Further, in the case where the video signal contains a plurality of color signals, it is possible to use the following data signal line driving circuit.

That is, the data signal line driving circuit of the present invention, which drives a plurality of data signal lines respectively so as to (i) multiphase a video signal having a plurality of color signals and (ii) fetch the video signal into the data signal lines, includes: a plurality of divisional video signal lines, divided so as to respectively correspond to the color signals, which constitute each of the video signal lines; and a video signal fetching section for fetching the video signal from the video signal lines into the data signal lines in each block when gathering data signal line groups, each made up of a predetermined number of the data signal lines sequentially connected to each of the divisional video signal lines so as to respectively correspond to the color signals, whose number is the same as the number of the video signal lines, said data signal line group being regarded as a single block.

Also in this case, it is always possible to forward the video signals different from each other to the video signal lines (polyphsae development), so that it is possible to suppress the power consumption in the low resolution driving compared with the case of the high resolution driving.

The display device of the present invention includes: a display panel which includes (i) a plurality of data signal lines, (ii) a plurality of scanning signal lines provided so as to cross the data signal lines, and (iii) pixels provided on intersections of the data signal lines and the scanning signal lines, a video signal for displaying an image being fetched from the data signal lines into the pixels in synchronism with a scanning signal supplied from the scanning signal lines, said video signal being retained; a data signal line driving circuit for outputting the video signal to the data signal lines in synchronism with a predetermined timing signal; and a scanning signal line driving circuit for outputting the scanning signal to the scanning signal lines in synchronism with a predetermined timing signal, said video signal being multiphased, and being supplied to the data signal lines via a plurality of video signal lines, wherein any one of the aforementioned data signal line driving circuits is used as the data signal line driving circuit.

According to the arrangement, even when the resolution of the video signal is high or even when the resolution of the video signal is low, it is possible to display an image in accordance with the multiphase development, so that it is possible to suppress the power consumption in the low resolution driving compared with the case of the high resolution driving. As a result, it is possible to reduce the power consumption of whole the display device.

Moreover, in the case of performing the high resolution driving, when a conventional data signal line driving circuit is arranged so that the video signal is fetched into the data signal lines in each block, an end portion of the block and a middle portion of the block are different from each other in terms of influence exerted by the adjacent data signal line, so that a stripe occurs in the end portion of the block in displaying an image. As a result, the display quality is deteriorated. However, according to the aforementioned arrangement, it is possible to uniform the influence that the data signal line receives from the adjacent data signal line in the whole block, thereby preventing the deterioration of the display quality.

It may be so arranged that: the data signal line driving circuit, the scanning signal line driving circuit, and the pixel are formed on the same substrate.

In this manner, the data signal line driving circuit, the scanning signal line driving circuit, and the pixel are formed on the same substrate, so that it is possible to reduce the installation cost and to improve the reliability.

For a fuller understanding of the nature and advantages of the invention, reference should be made to the ensuing detailed description taken in conjunction with the accompanying drawings.

BRIEF DESCRIPTION OF THE DRAWINGS

FIG. 10(*b*) shows a conventional multiphased video signal.

FIG. 10(*c*) shows a video signal used in the present invention.

FIG. 26 shows a table, "TABLE 1", comparing reduction of power consumption in low resolution versus high resolution driving modes between embodiments of the invention with (FIG. 1) and without (FIG. 13) shift register bypassing and a prior art circuit (FIG. 22).

DESCRIPTION OF THE EMBODIMENTS

Embodiment 1

The following description will explain one embodiment of the present invention. Note that, the present embodiment describes an example where the data signal line driving circuit of the present invention is applied to a matrix type image display device.

Figure 2:
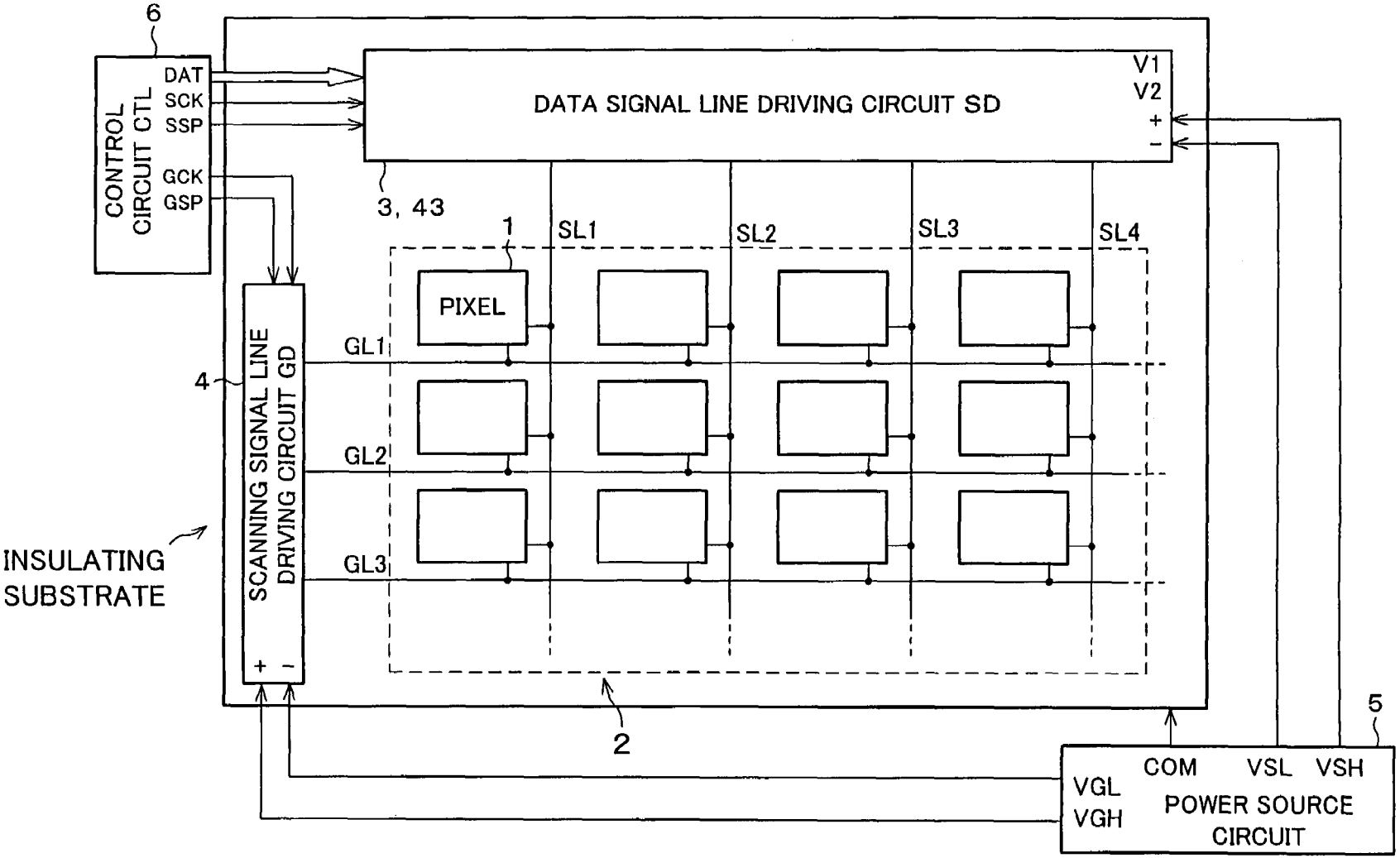
FIG. 2 is a block diagram schematically showing an image display device provided with the data signal line driving circuit shown in FIG. 1.

As shown in FIG. 2, the matrix type image display device according to the present embodiment includes: m number of data signal lines SLx ($1 \leqq x \leqq m$); n number of scanning signal lines GLy ($1 \leqq y \leqq n$) that cross the data signal lines SLx; pixels 1 disposed on intersections of the data signal lines SLx and the scanning signal lines GLy; and a pixel array 2 having a driver monolithic structure in which a data signal line driving circuit 3 for driving the data signal lines SLx and a scanning signal line driving circuit 4 for driving the scanning signal lines GLy are disposed on an insulating substrate constituted of a glass substrate or the like.

The pixel array 2 includes a display section constituted of an m×n number of the pixels 1, so that the resolution of the display section is m×n. This means that the maximum resolution of the display section of the image display device shown in FIG. 2 is m×n. Note that, in the present embodiment, it is possible to appropriately display a video signal whose resolution is lower than the maximum resolution of the display section. This point will be detailed later.

Further, the image display device includes not only the pixel array 2 but also (i) a power source circuit 5 for supplying a driving power source to the data signal line driving circuit 3 and the scanning signal line driving circuit 4 and (ii) a control circuit 6 for supplying various kinds of signals to the data signal line driving circuit 3 and the scanning signal line driving circuit 4.

The power source circuit 5 applies (i) a high-level voltage VSH and (ii) a low-level voltage VSL as drive power sources to the data signal line driving circuit 3, and applies (a) a high-level voltage VGH and (ii) a low-level voltage VGL as drive power sources to the scanning signal line driving circuit 4. Further, the power source circuit 5 applies a common voltage COM to a common line (not shown), provided on the pixel array 2, which is connected to each pixel 1.

The control circuit 6 supplies a clock signal SCK and a start pulse SSP to the data signal line driving circuit 3, and supplies a clock signal GCK and a start pulse GSP to the scanning signal driving line circuit 4. Further, the control circuit 6 converts a digital video signal inputted from the outside into an analog video signal DAT, and supplies the analog video signal DAT to the data signal line driving circuit 3. How the video signal is converted into the video signal DAT will be detailed later.

The image display device is arranged so that: in the pixel array 2, a polycrystalline silicon thin film transistor (Poly Si TFT) is used as an active element which constitutes each of the pixel 1, the data signal line driving circuit 3, and the scanning signal line driving circuit 4 so that they are formed on the insulating substrate in a monolithic manner. Thus, it is possible to form the driving circuits (data signal line driving circuit 3, scanning signal line driving circuit 4) and the pixels on the same substrate in accordance with the same process, thereby reducing the manufacturing cost.

As an example of the image display device formed in a monolithic manner, the following description will briefly describe a structure of the transistor and a manufacturing method thereof in a case where the polycrystalline silicon thin film transistor is used to form the pixel array 2 and the active elements of the aforementioned driving circuits 3 and 4.

Figure 3:
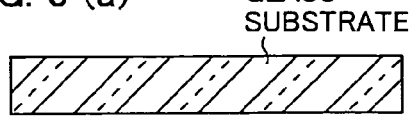
FIGS. 3(*a*) to 3(*k*) show steps of manufacturing a TFT which constitutes a pixel of the image display device shown in FIG. 2.
Figure 3:
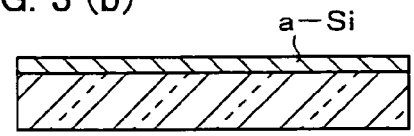
Figure 3:
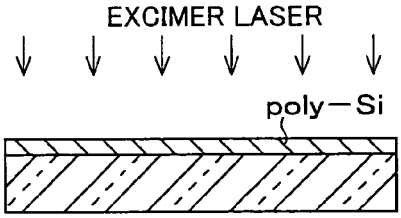
Figure 3:
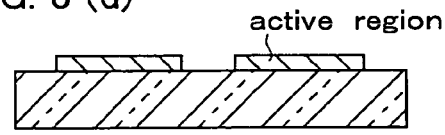
Figure 3:
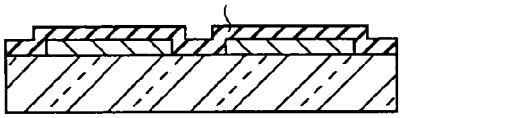
Figure 3:
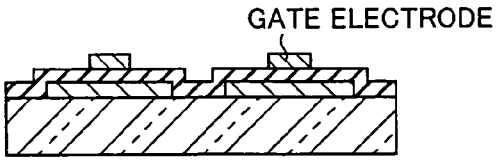
Figure 3:
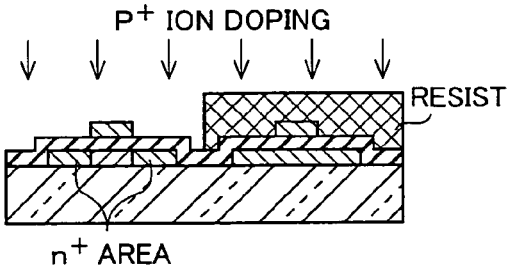
Figure 3:
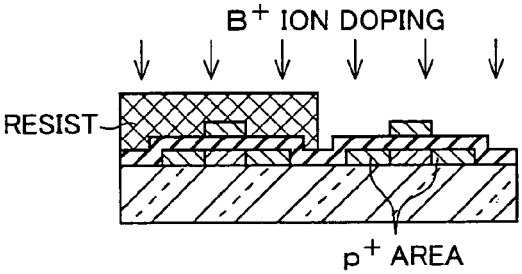
Figure 3:
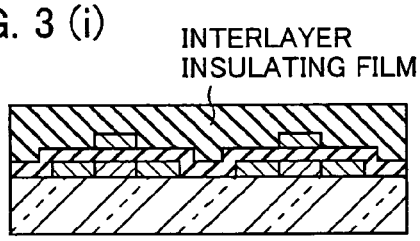
Figure 3:
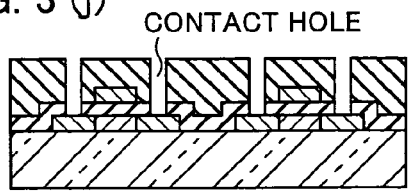
Figure 3:
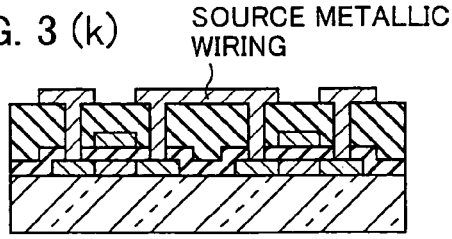

That is, as shown in FIG. 3(*b*), an amorphous silicon thin film (a-Si) is deposited on a glass substrate shown in FIG. 3(*a*). Further, as shown in FIG. 3(*c*), excimer laser is emitted to the amorphous silicon thin film, so that the amorphous silicon thin film is changed to a polycrystalline silicon thin film (poly-Si).

Further, as shown in FIG. 3(*d*), patterning is performed with respect to the polycrystalline silicon thin film so as to have a desired shape, and the pattern is formed as an activated area. Thereafter, as shown in FIG. 3(*e*), a gate insulating film made of silicon dioxide is formed on the polycrystalline silicon thin film.

Further, in FIG. 3(*f*), after forming a gate electrode of a thin film transistor on the gate insulating film by using aluminium or the like, impurities are injected into an area which functions as a source/drain area of the thin film transistor in FIG. 3(*g*) and FIG. 3(*h*). Here, phosphor is injected into an n-type area and boron is injected into a p-type area. Note that, before injecting the impurities into the one of the areas, the other is covered by a resist, so that it is possible to inject the impurities only into a desired area.

Further, as shown in FIG. 3(*i*), an interlayer insulating film made of silicon dioxide or silicon nitride is deposited on the gate insulating film and the gate electrode, and as shown in FIG. 3(*j*), after forming a contact hole, a metallic wiring made of aluminium or the like is formed as shown in FIG. 3(*k*).

Figure 4:
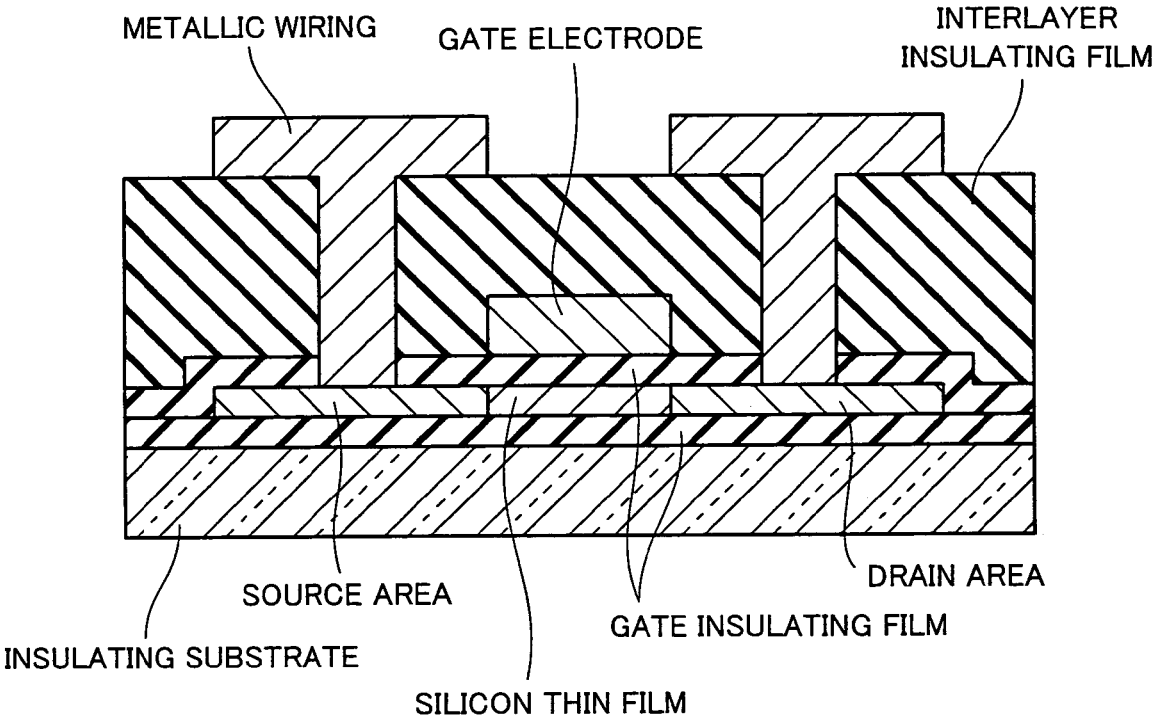
FIG. 4 is a cross sectional view of the TFT which constitutes the image display device shown in FIG. 2.

Thus, as shown in FIG. 4, it is possible to form a thin film transistor having a forward stagger (top gate) structure in which the polycrystalline silicon thin film on the insulating substrate is used as an active layer. Note that, FIG. 4 shows an example of an n-ch transistor. In the n-type area, the polycrystalline silicon thin film positioned on the lower side of the gate electrode is sandwiched so as to be pushed in a direction of a surface of the insulating substrate, and the one area adjacent to the polycrystalline silicon thin film functions as a source area and the other area oppositely adjacent to the polycrystalline silicon thin film functions as a drain area.

In this manner, by using the polycrystalline silicon thin film transistor, it is possible to provide the data signal line driving circuit 3 and the scanning signal line driving circuit 4, each of which has a practical driving force, on the substrate having the pixel array 2 in accordance with substantially the same manufacturing process as in the pixel array 2. Note that, the foregoing description illustrates the thin film transistor having the corresponding structure as an example, but it is possible to obtain substantially the same effect by using a polycrystalline thin film transistor having another structure such as an inversely staggered structure.

Here, in the process shown in FIG. 3(*a*) to FIG. 3(*k*), the maximum temperature in the process is 600° C. corresponding to a temperature in forming the gate insulating film. Thus, it is possible to use a high heat resistance glass, such as 1737 glass made by Coning (U.S.A.), as the insulating substrate.

In this manner, by forming the polycrystalline silicon thin film transistor at a temperature not more than 600° C., it is possible to use a glass substrate, having a large area, which can be produced at low cost, as the insulating substrate. As a result, it is possible to realize an image display device having a large display area at low cost.

Note that, in the case where the image display device is a liquid crystal display device, there is further formed a transmission electrode (in a case of a transmission type liquid crystal display device) or a reflection electrode (in a case of a reflection type liquid crystal display device) via another interlayer insulating film.

Figure 5:
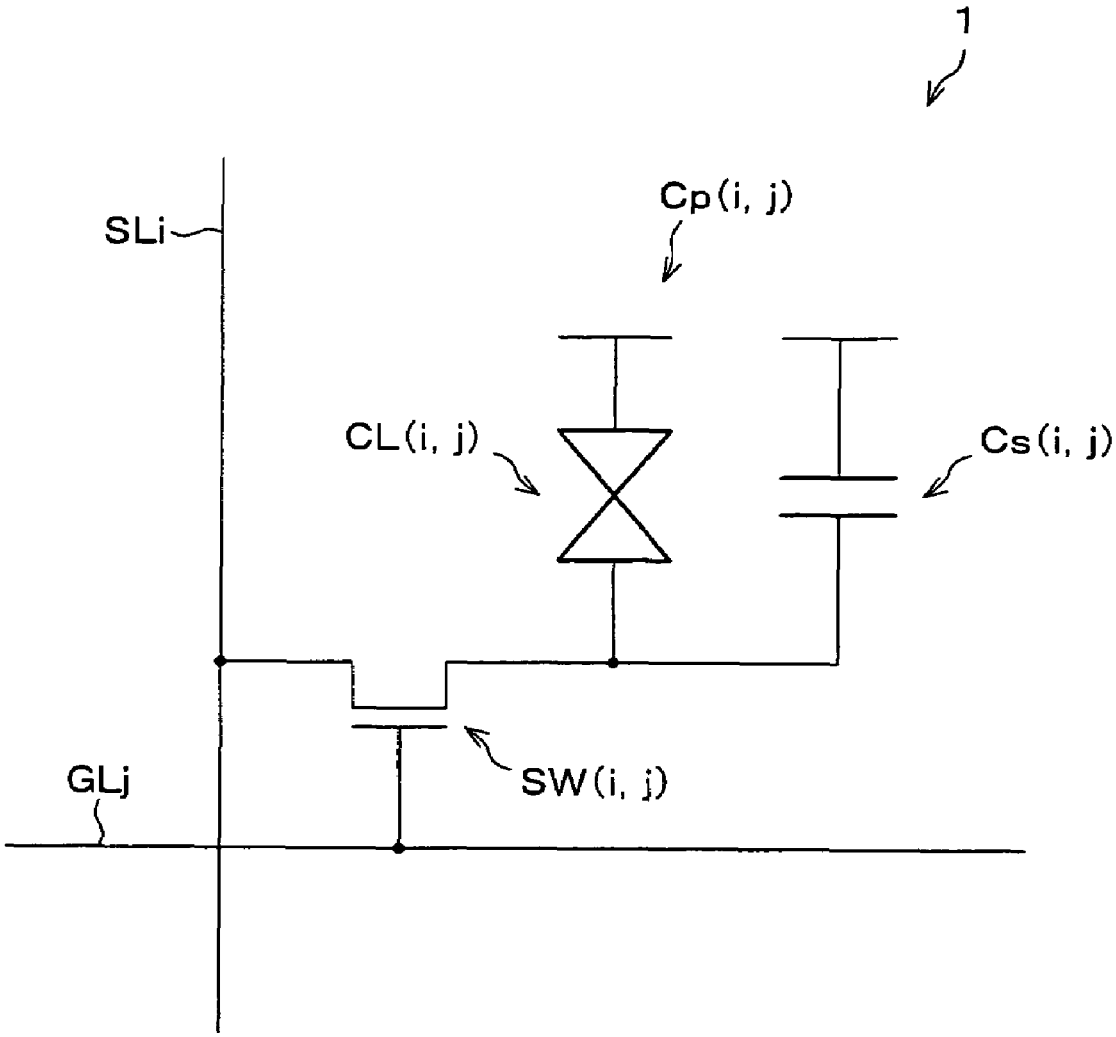
FIG. 5 is a schematic showing the pixel of the image display device shown in FIG. 2.

In a case where the image display device arranged in the foregoing manner is a liquid crystal display device for example, as shown in FIG. 5, the pixel which functions as a switching element includes: an electric field effect transistor SW (i, j) in which its gate is connected to the scanning signal line GLj and its drain is connected to the data signal line SLi; and a pixel capacitor Cp (i, j) having an end (electrode) connected to a source of the electric field effect transistor SW (i, j). Further, another end of the pixel capacitor Cp (i, j) is connected to a common electrode line shared by all the pixels PIX . . . . The pixel capacitor Cp (i, j) is constituted of a liquid crystal capacitor CL (i, j) and an auxiliary capacitor Cs (i, j) which is added as required. Here, i corresponds to an arbitrary data signal line SLi (1≦i≦m), and j corresponds to an arbitrary scanning signal line GLj (1≦j≦n).

In the pixel PIX (i, j), when the scanning signal line GLj is selected, the electric field effect transistor SW (i, j) conducts, and a voltage having been applied to the data signal line SLi is applied to the pixel capacitor Cp (i, j). While the electric field effect transistor SW (i, j) is OFF after a period for selecting the scanning signal line GLj has ended, the pixel capacitor Cp (i, j) retains the voltage in the OFF state.

Here, transmittance or reflection of the liquid crystal varies depending on a voltage applied to the liquid crystal capacitor CL (i, j). Thus, the scanning signal line GLj is selected and a voltage according to video data outputted to the corresponding pixel PIX (i, j) is applied to the data signal line SLi, so that it is possible to vary a display condition of the corresponding pixel PIX (i, j) in accordance with the video data D.

Note that, the foregoing description illustrates the case of the liquid crystal as an example, but it is possible to use a pixel arranged in another manner, regardless of whether the pixel is self-luminous or not, as long as the pixel PIX (i, j) can adjust the brightness, in accordance with a value of a signal applied to the data signal line SLi, while a signal indicative of selection is being applied to the scanning signal line GLj.

In the foregoing arrangement, the scanning signal line driving circuit 4 shown in FIG. 2 outputs a signal, such as a voltage signal, which indicates whether it is the selection period or not, to the respective scanning signal lines GL1 to GLn. Further, the scanning signal line driving circuit 4 changes the scanning signal line GLj which outputs a signal indicative of the selection period, for example, in accordance with a timing signal such as a clock signal GCK or a start pulse signal GSP which is given by the control circuit 6. Thus, the scanning signal lines GL1 to GLn are sequentially selected at predetermined timings.

Further, the data signal line driving circuit 3 samples sets of video data D . . . inputted to the respective pixels PIX . . . in a time-divisional manner so as to extract sets of the video data D . . . respectively. Further, the data signal line driving circuit 3 outputs an output signal, according to each video data D, to each of the pixels PIX (1, j) to PIX (m, j), corresponding to the scanning signal line GLj selected by the scanning signal line driving circuit 4, via each of the data signal lines SL1 to SLm.

Note that, the video signal DAT corresponds to any one of plural resolutions that have been predetermined. In the present embodiment, (i) the video signal DAT and (ii) a resolution switching signal (drive switching control signal) indicative of the corresponding resolution are inputted from the control circuit 6. Further, the data signal line driving circuit 3 determines the sampling timing and an output timing of the output signal in accordance with the timing signals such as the clock signal SCK and the start pulse SPS that are inputted from the control circuit 6.

Each of the pixels PIX (1, j) to PIX (m, j) determines its brightness by adjusting the luminance and the transmittance in emitting light, in accordance with an output signal given to each of the corresponding data signal lines SL1 to SLm, while the corresponding scanning signal line GLj is selected.

Here, the scanning signal line driving circuit 4 sequentially selects the scanning signal lines GL1 to GLn. Thus, it is possible to set the brightness indicated by the video data D corresponding to each of all the pixels 1 in the pixel array 2, thereby changing an image display on the pixel array 2.

Further, the data signal line driving circuit 3 inputs multiphased video signals to respectively independent video signal lines, and drives the data signal line SL while performing the multiphase development, thereby supplying either of a high resolution video signal or a low resolution video signal. The following description explains this condition. Note that, in the case of the low resolution, it is assumed that a video signal whose horizontal resolution is half of the high resolution is inputted.

Figure 1:
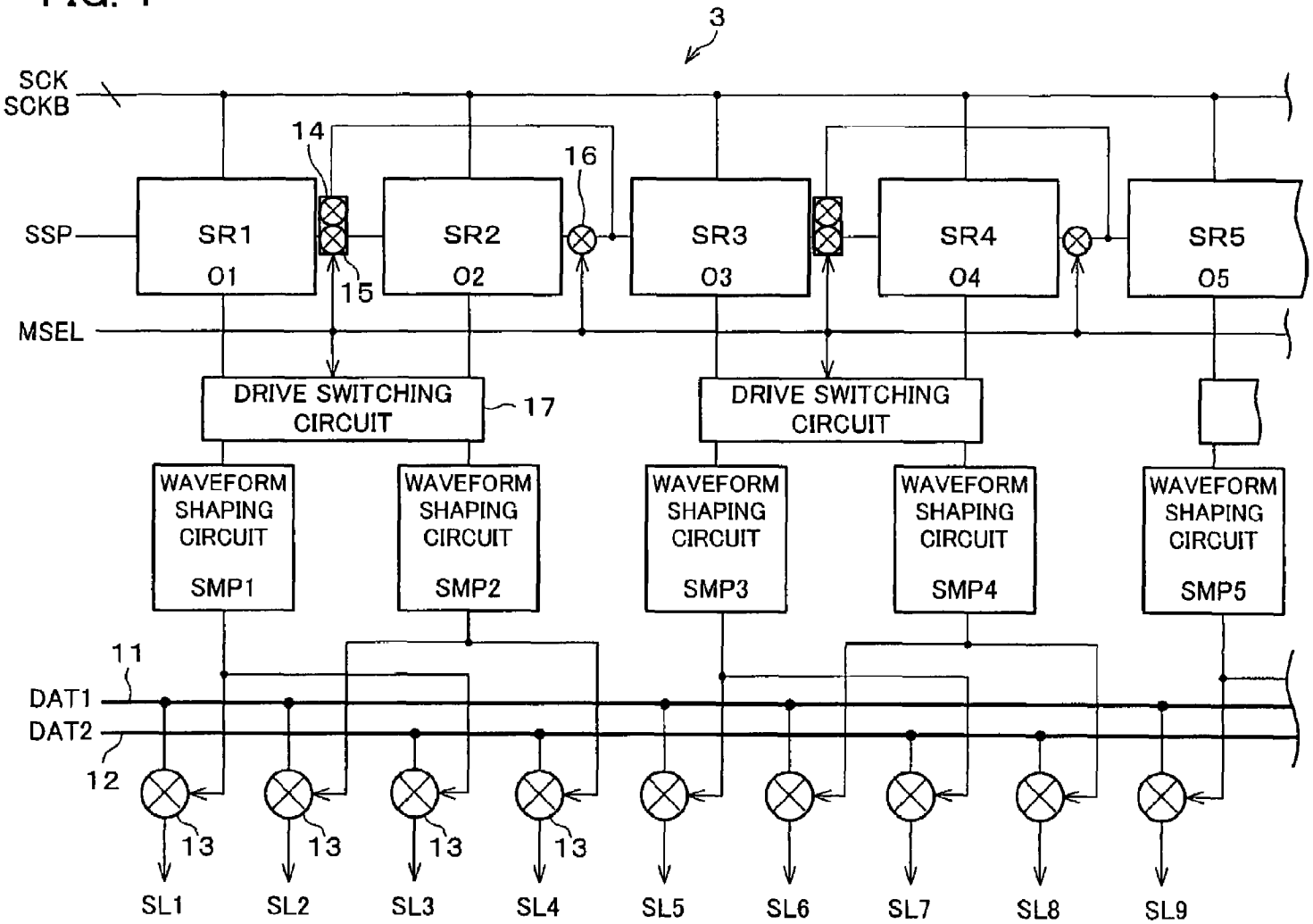
FIG. 1 is a block diagram schematically showing a data signal line driving circuit according to one embodiment of the present invention.

As shown in FIG. 1, the data signal line driving circuit 3 includes two video signal lines 11 and 12, independent from each other, which receive the two-phase video signals DAT1 and DAT2.

Data signal line groups each of which is constituted of two sequential data signal lines (such as SL1, SL2, and SL5, SL6) are connected to the video signal line 11 receiving the video signal DAT1 so that two data signal lines are alternately connected thereto with interval of another two data signal lines therebetween. Here, the data signal lines SL1 and SL2 constitute a single data signal line group, and the data signal lines SL5 and SL6 constitute a single data signal line group.

Data signal line groups each of which is constituted of two sequential data signal lines (such as SL3, SL4, and SL7, SL8) are connected to the video signal line 12 receiving the video signal DAT2 so that two data signal lines are alternately connected thereto with interval of another two data signal lines therebetween. Here, the data signal lines SL3 and SL4 constitute a single data signal line group, and the data signal lines SL7 and SL8 constitute a single data signal line group.

In this manner, the data signal line driving circuit 3 is arranged so that: two data signal lines SL are connected to the video signal line 11 and another two data signal lines SL are connected to the data signal line 12 so that the two data signal lines SL and the another two data signal lines SL alternately appear.

That is, two sequential data signal lines constitute each of the data signal line groups, connected to the video signal lines 11 and 12, and the data signal line groups whose number is the same as the number of the video signal lines constitute a single block. Here, (i) a data signal line group constituted of the data signal lines SL1 and SL2 and (ii) a data signal line group constituted of the data signal lines SL3 and SL4 make up a single block.

A sampling pulse from the waveform shaping circuit SMP1 is inputted to switching elements 13 of the data signal lines SL1 and SL3. A sampling pulse from the waveform shaping circuit SMP2 is inputted to switching elements 13 of the data signal lines SL2 and SL4. In this manner, as to the same waveform shaping circuit SMP, the switching elements 13 of the data signal lines connected to the video signal lines different from each other input the sampling pulses. Thus, the video signals DAT1 and DAT2 are simultaneously sampled with respect to the data signal lines SL respectively connected to the video signal lines 11 and 12.

That is, in the data signal line driving circuit 3 arranged in the foregoing manner, the video signals are fetched from the video signal lines into the data signal lines in each block.

The waveform shaping circuit SMP is connected to the shift resister SR, and an output signal of the shift resister SR is inputted to the waveform shaping circuit SMP. The output signal of the shift resister SR is a signal which functions as a sampling pulse for fetching the video signal into the data signal line. That is, a waveform of the output signal of the shift resister SR is shaped by the waveform shaping circuit SMP so as to be a sampling pulse.

A plurality of the shift resisters SR are provided as SR1, SR2, . . . .

Two switching elements 14 and 15 are provided between the shift resisters SR1 and SR2, and a switching element 16 is provided between the shift resisters SR2 and SR3. In this manner, (i) switching elements 14 and 15 and (ii) the switching element 16 are alternately provided between the shift resisters SR adjacent to each other.

The switching elements 14 and 15 operate in an opposite manner in terms of an ON/OFF state. That is, when the switching element 14 is ON, the switching element 15 is OFF. When the switching element 14 is OFF, the switching element 15 is ON. Further, the switching element 16 is turned ON/OFF as in the switching element 15.

Here, when the switching element 14 is ON, the switching elements 15 and 16 are OFF, so that an output from the shift resister SR1 is inputted to the shift resister SR3 without being inputted to the next shift resister SR2. Further, an output from the shift resister SR3 is inputted to the shift resister SR5 without being inputted to the next shift resister SR4. In this manner, when the switching element 14 is ON, an output from the shift resister SR1 is transmitted in a sequential manner without being inputted to the next stage.

While, when the switching element 14 is OFF, the switching elements 15 and 16 are ON, and the output from the shift resister SR1 is transmitted from the next shift resister SR2 in a sequential manner.

A binary drive switching control signal MSEL is inputted to each of the switching elements 14 to 16, so that an ON/OFF state is controlled.

Further, a drive switching circuit 17 is provided between (i) the shift resisters SR1 and SR2 and (ii) the waveform shaping circuits SMP1 and SMP2.

The drive switching circuit 17 is switched so as to supply an output signal O1 of the shift resister SR1 only to the waveform shaping circuit SMP1 or supply the output signal O1 to both the waveform shaping circuits SMP1 and SMP2. Note that, the drive switching circuit 17 causes an output signal O2 of the shift resister SR2 to be supplied to the waveform shaping circuit SMP2 in the case of supplying the output signal O1 of the shift resister SR1 only to the waveform shaping circuit SMP1.

The drive switching circuit 17 is provided between (i) the shift resisters SR3 and SR4 and (ii) the waveform shaping circuits SMP3 and SMP4. Also in this case, the drive switching circuit 17 operates in the same manner as in the aforementioned drive switching circuit 17 provided between (i) the shift resisters SR1 and SR2 and (ii) the waveform shaping circuits SMP1 and SMP2.

That is, the drive switching circuit 17 is switched so as to supply an output signal O3 of the shift resister SR3 only to the waveform shaping circuit SMP3 or supply the output signal O3 to both the waveform shaping circuits SMP3 and SMP4. Note that, the drive switching circuit 17 causes an output signal O4 of the shift resister SR4 to be supplied to the waveform shaping circuit SMP4 in the case of supplying the output signal O3 of the shift resister SR3 only to the waveform shaping circuit SMP3.

The drive switching control signal MSEL controls the drive switching circuit 17 so as to switch the drive switching circuit 17 ON/OFF. In this case, an ON state of the drive switching circuit 17 is such condition that the shift resister SR1 outputs two output signals, and an OFF state of the drive switching circuit 17 is such condition that the shift resister SR1 outputs a single output signal.

Further, ON/OFF of the drive switching circuit 17 corresponds to ON/OFF of the switching element 14. That is, when the switching element 14 is ON, the drive switching circuit 17 is ON. When the switching element 14 is OFF, the drive switching circuit 17 is OFF. Thus, when the drive switching circuit 17 is ON, the switching elements 15 and 16 are OFF. Thus, the shift resister SR2 is not driven, so that the shift resister SR2 stops operating. That is, the drive switching circuit functions as stopping means for stopping operation of the shift resister whose driving (operation) is not required.

In this manner, by using the drive switching circuit 17, it is possible to cause the shift resisters SR1, 3, 5, . . . , and (2i-1) . . . to output a single output signal or two output signals, and it is possible to cause the shift resisters SR2, 4, . . . , 2i to stop driving or to drive. Here, i is an integer number in a range of $1 \leqq i \leqq m/2$. Further, m represents the number of the data signal lines.

The drive switching control signal MSEL is a binary signal indicative of a high level or a low level, and is generated by the aforementioned control circuit 6. The drive switching control signal MSEL is switched in accordance with the resolution of the video signal inputted to the data signal line driving circuit 3. Note that, in the present embodiment, when the high resolution driving is performed, that is, when the video signal whose resolution is the same as the number of the pixels (resolution) of the pixel array 2 is inputted to the data signal line driving circuit 3, the drive switching control signal MSEL is switched to a low level, and when the low resolution driving is performed, that is, when the video signal whose resolution is lower than the number of the pixels (resolution) of the pixel array 2 is inputted to the data signal line driving circuit 3, the drive switching control signal MSEL is switched to a high level.

Thus, in the data signal line driving circuit 3, when the high resolution driving is performed, a level of the drive switching control signal MSEL is low, so that the switching element 14 is OFF, and the switching elements 15 and 16 are ON, and the drive switching circuit 17 is OFF. Thus, the shift resisters SR at all the stages operate, and output signals of the respective shift resisters SR are inputted to the corresponding waveform shaping circuits SMP, so that each data signal line SL connected to the video signal line 11 and each data signal line SL connected to the video signal line 12 are driven at the same time.

Further, in the data signal line driving circuit 3, when the low resolution driving is performed, a level of the drive switching control signal MSEL is high, so that the switching element 14 is ON, and the switching elements 15 and 16 are OFF, and the drive switching circuit 17 is ON. Thus, every other shift resister SR operates, and an output signal of a single shift resister SR is inputted to two waveform shaping circuits SMP, so that two data signal lines SL connected to the video signal line 11 and two data signal lines SL connected to the video signal line 12 are driven at the same time.

Thus, by controlling drive of the data signal line driving circuit 3 in accordance with the drive switching control signal MSEL as described above, it is possible to adjust an apparent resolution to the horizontal resolution of the video signal. For example, in a case where an image indicated by a video signal of SVGA (super video graphics array) is displayed in an image display device whose physical maximum display resolution is UXGA (ultra-extended graphics array) for example, it is possible to display the image with high quality even when the horizontal resolution of the inputted video signal is less than the maximum value of the physical display resolution in a horizontal direction of the image display device.

As described above, the shift resister SR, the drive switching circuit 17, and the waveform shaping circuit SMP are such that: when the data signal line groups, connected to different video signal lines, whose number is the same as the number of the video signal lines, make up a single block, a video signal fetching section fetches the video signal from the video signal lines into the data signal line in each block.

Here, the following description explains (i) operations of the data signal line driving circuit 3 in performing the high resolution driving and (ii) operations of the data signal line driving circuit 3 in performing the low resolution driving. Here, the high resolution driving is referred to as "first driving" recited in claims and the low resolution driving is referred to as "second driving" recited in claims.

Figure 6:
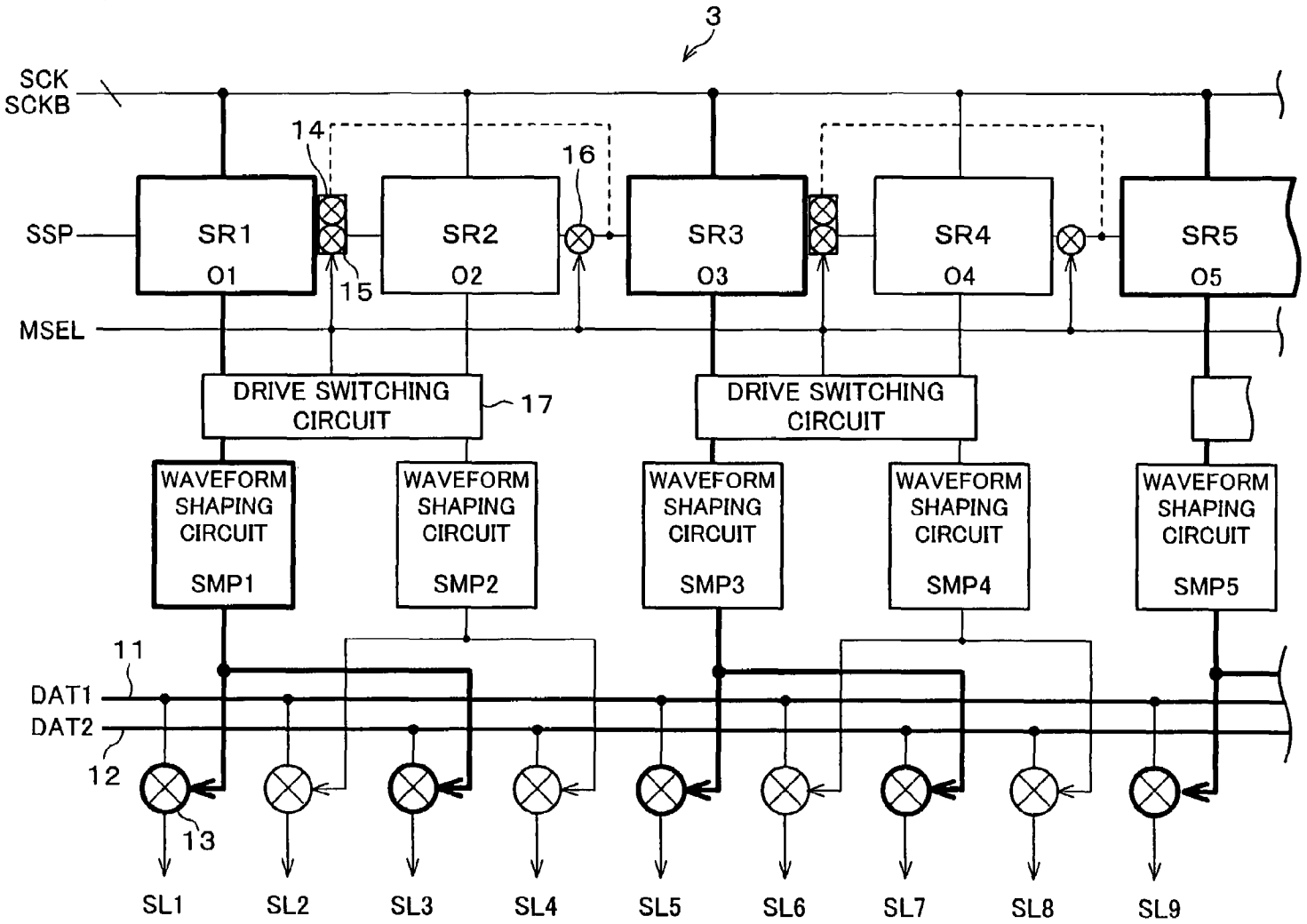
FIG. 6 shows a condition under which high resolution driving is performed in the data signal line driving circuit shown in FIG. 1.

First, the operations of the data signal line driving circuit 3 in performing the high resolution driving are described with reference to FIG. 6 and FIG. 7. FIG. 6 is a block diagram schematically showing the data signal line driving circuit 3, and FIG. 7 is a timing chart of various kinds of signals in the data signal line driving circuit 3 in performing the high resolution driving.

Here, the video signal DAT1 inputted to the video signal line 11 of the data signal line driving circuit 3 and the video signal DAT2 inputted to the video signal line 12 of the data signal line driving circuit 3 are obtained by converting digital video signals (DATA1, 2, 3, 4, 5, 6, 7, 8, 9, 10, . . . ), each of which is an original signal, into analog signals after changing an order of the DATA to an order suitable for sampling. The video signal DAT1 and the video signal DAT2 will be detailed later.

Figure 7:
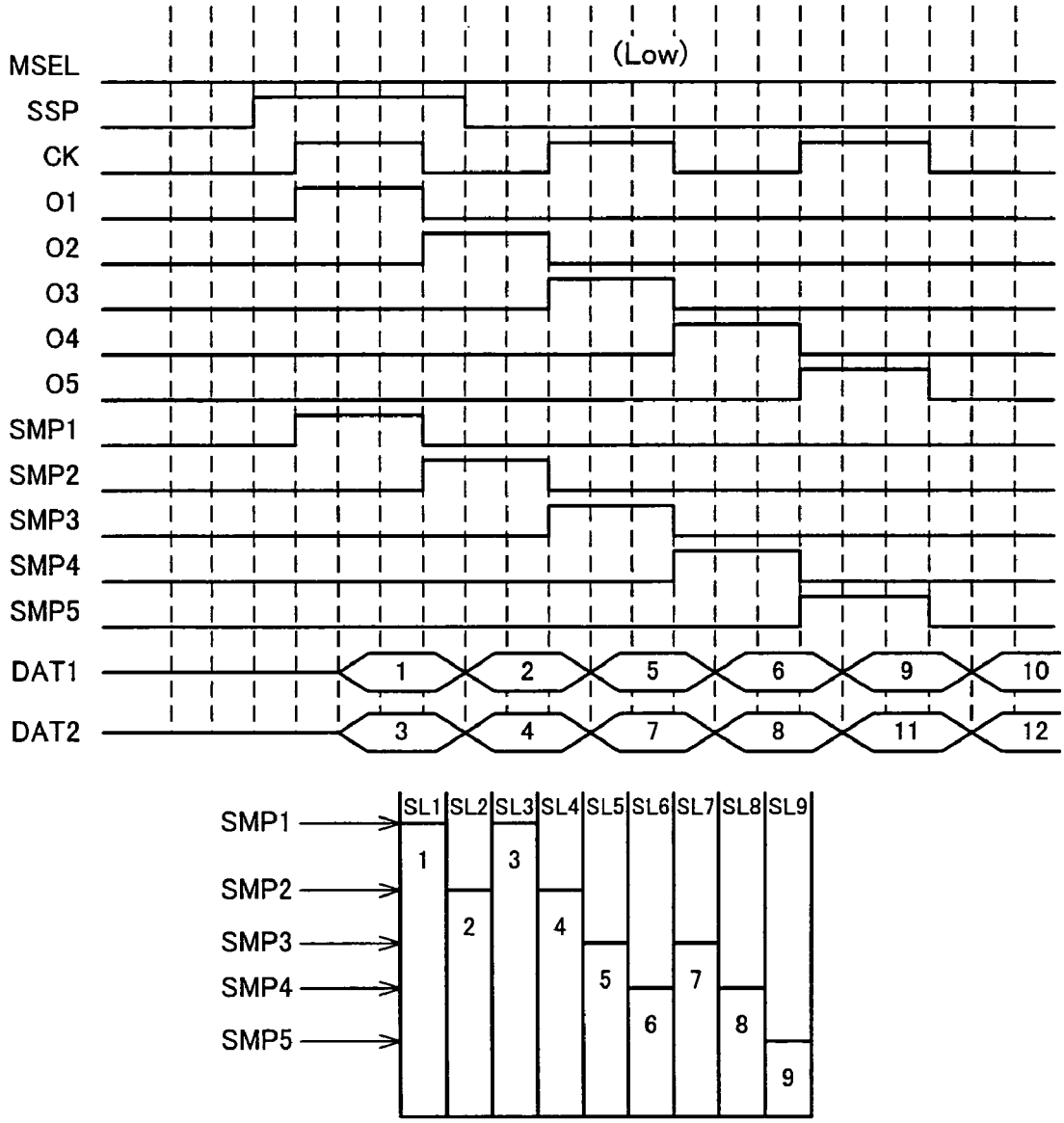
FIG. 7 is a timing chart of various kinds of signals in the case where the high resolution driving is performed in the data signal line driving circuit shown in FIG. 1.

When the high resolution driving is performed, as shown by the timing chart of FIG. 7, a level of the drive switching control signal MSEL is low, so that the switching elements 14 and the drive switching circuits 17 are OFF, and the switching elements 15 and the switching elements 16 are ON.

Thus, first, the shift resister SR1 at the first stage is driven by the start pulse SSP, and the clock signals SCK and SCKB (inversion signal of SCK, not shown in FIG. 7), so as to output a signal O1. The output signal O1 is outputted only to the waveform shaping circuit SMP1, and its waveform is shaped by the waveform shaping circuit SMP1, and the output signal O1 is transmitted to the switching elements 13 of the data signal line SL1 and the data signal line SL3 as a sampling pulse SMP1, and DATA1 of the video signal DAT1 flowing in the video signal line 11 and DATA3 of the video signal DAT2 flowing in the video signal line 12 are sampled.

Next, the shift resister SR2 at the next stage is driven so as to output a signal O2. The output signal O2 is outputted only to the waveform shaping circuit SMP2, and its waveform is shaped by the waveform shaping circuit SMP2, and the output signal O2 is transmitted to the switching elements 13 of the data signal line SL2 and the data signal line SL4, and DATA2 of the video signal DAT1 flowing in the video signal line 11 and DATA4 of the video signal DAT2 flowing in the video signal line 12 are sampled.

Likewise, the shift resisters SR are sequentially driven, and a portion surrounded by a thick line of FIG. 6 and a portion surrounded by a thin line of FIG. 6 are alternately driven, and the data signal lines SL adjacent to each other are subjected to the sampling at different timings, and every other data signal line SL is subjected to the sampling at the same timing.

That is, as shown in FIG. 7, in accordance with the sampling pulse SMP1, the video signal DAT1 (DATA1) and the video signal DAT2 (DATA3) are simultaneously sampled by the data signal line SL1 and the data signal line SL3. In accordance with the sampling signal SMP2, the video signal DAT1 (DATA2) and the video signal DAT2 (DATA4) are simultaneously sampled by the data signal line SL2 and the data signal line SL4. In the same manner, the video signal DAT1 and the video signal DAT2 are sampled.

In this manner, when the high resolution driving is performed, different DATA are fetched into all of the data signal lines SL1 to SLm, so that it is possible to display an image in the image display device with the maximum resolution (maximum horizontal resolution).

Figure 8:
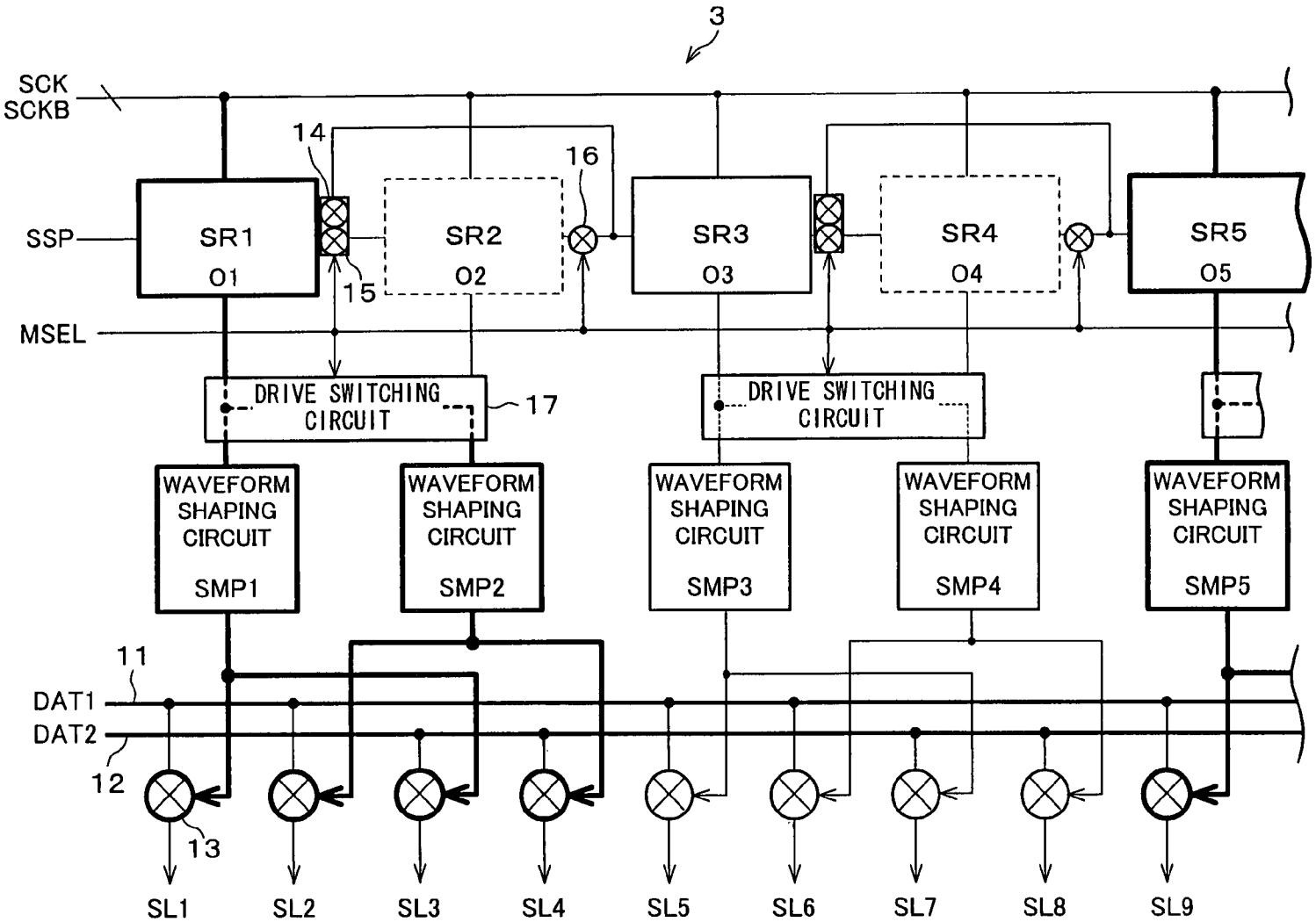
FIG. 8 shows a condition under which low resolution driving is performed in the data signal line driving circuit shown in FIG. 1.

Next, the operations of the data signal line driving circuit 3 in performing the low resolution driving is described with reference to FIG. 8 and FIG. 9. FIG. 8 is a block diagram schematically showing the data signal line driving circuit 3, and FIG. 9 is a timing chart of various kinds of signals in the data signal line driving circuit 3 in performing the low resolution driving.

Here, the video signal DAT1 inputted to the video signal line 11 of the data signal line driving circuit 3 and the video signal DAT2 inputted to the video signal line 12 of the data signal line driving circuit 3 are obtained by converting digital video signals (DATA1, 2, 3, 4, 5, 6, 7, 8, 9, 10, . . . ), each of which is an original signal, into analog signals after changing an order of the DATA to an order suitable for sampling. The video signal DAT1 and the video signal DAT2 will be detailed later.

Figure 9:
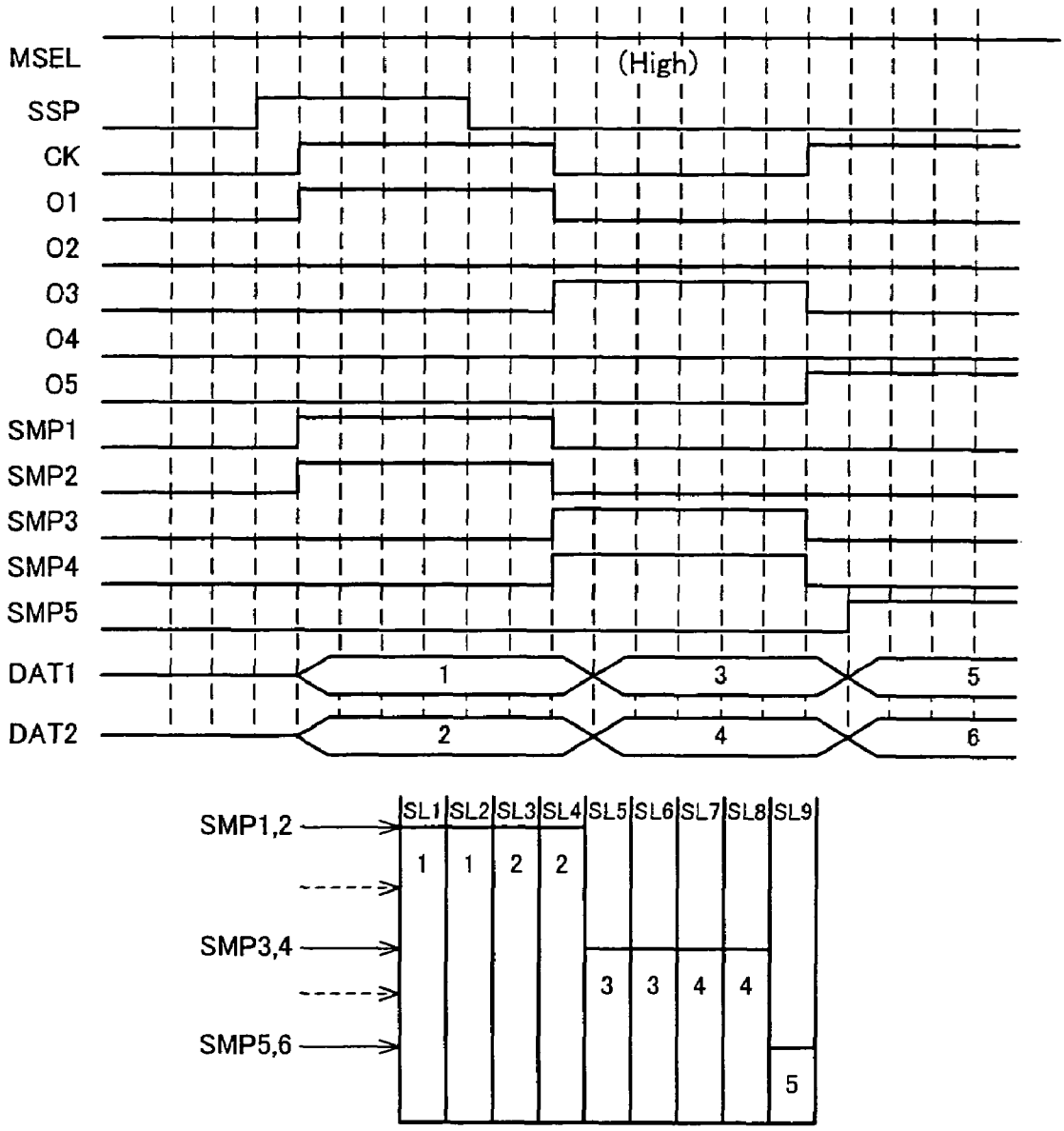
FIG. 9 is a timing chart of various kinds of signals in the case where the low resolution driving is performed in the data signal line driving circuit shown in FIG. 1.

When the low resolution driving is performed, as shown by the timing chart of FIG. 9, a level of the drive switching control signal MSEL is high, so that the switching elements 14 and the drive switching circuits 17 are ON, and the switching elements 15 and the switching elements 16 are OFF.

Thus, first, the shift resister SR1 at the first stage is driven by the start pulse SSP, and the clock signals SCK and SCKB, so as to output an signal O1. The output signal O1 is outputted to the waveform shaping circuit SMP1 and the waveform shaping circuit SMP2, and its waveform is shaped by the waveform shaping circuit SMP1 and the waveform shaping circuit SMP2, and the output signal O1 is transmitted to the switching elements 13 of the data signal line SL1, the data signal line SL3, the data signal line SL2, and the data signal line SL4, as a sampling pulses SMP1 and a sampling pulse SMP2, and DATA1 of the video signal DAT1 flowing in the video signal line 11 and DATA2 of the video signal DAT2 flowing in the video signal line 12 are sampled. That is, four data signal lines SL are simultaneously driven.

Next, instead of the shift resister SR2 at the next stage, the shift resister SR3 at the third stage is driven, so as to output a signal O3. The output signal O3 is outputted to the waveform shaping circuit SMP3 and the waveform shaping circuit SMP4, and its waveform is shaped by the waveform shaping circuit SMP3 and the waveform shaping circuit SMP4, and the output signal O3 is transmitted to the switching elements 13 of the data signal line SL5, the data signal line SL7, the data signal line SL6, and the data signal line SL8, as a sampling pulse SMP3 and a sampling pulse SMP4, and DATA3 of the video signal DAT1 flowing in the video signal line 11 and DATA4 of the video signal DAT2 flowing in the video signal line 12 are sampled. Also in this case, four data signal lines are simultaneously driven.

Likewise, every other shift resister SR is driven so that, instead of the shift resister SR4, the shift resister SR5 is driven, and the data signal lines SL, sequentially connected to the same video signal line, which are adjacent to each other, are subjected to the sampling at the same timing.

That is, as shown in FIG. 9, in accordance with the sampling pulses SMP1 and SMP2, DATA1 of the video signal DAT1 is sampled by the data signal line SL1 and the data signal line SL2, and DATA2 of the video signal DAT2 is sampled by the data signal line SL3 and the data signal line SL4.

In this manner, when the low resolution driving is performed, the same DATA is fetched into every two data signal lines of the data signal lines SL1 to SLm, so that it is possible to display a video signal whose horizontal resolution is half of the maximum resolution (maximum horizontal resolution) of the image display device.

Figure 10:
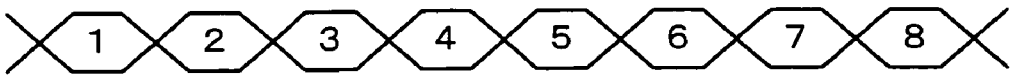
FIG. 10(*a*) shows an original video signal.
Figure 10:
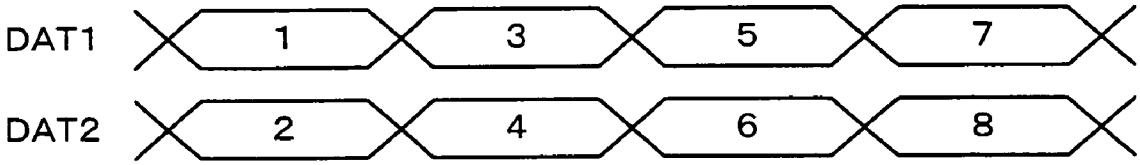
Figure 10:
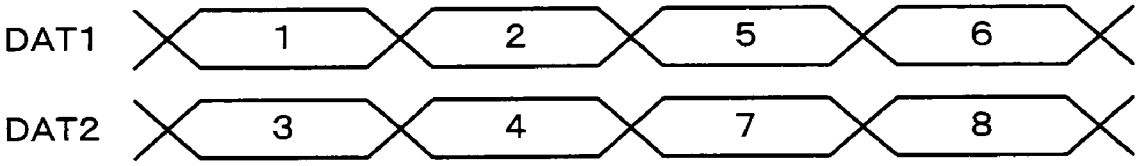
Figure 11:
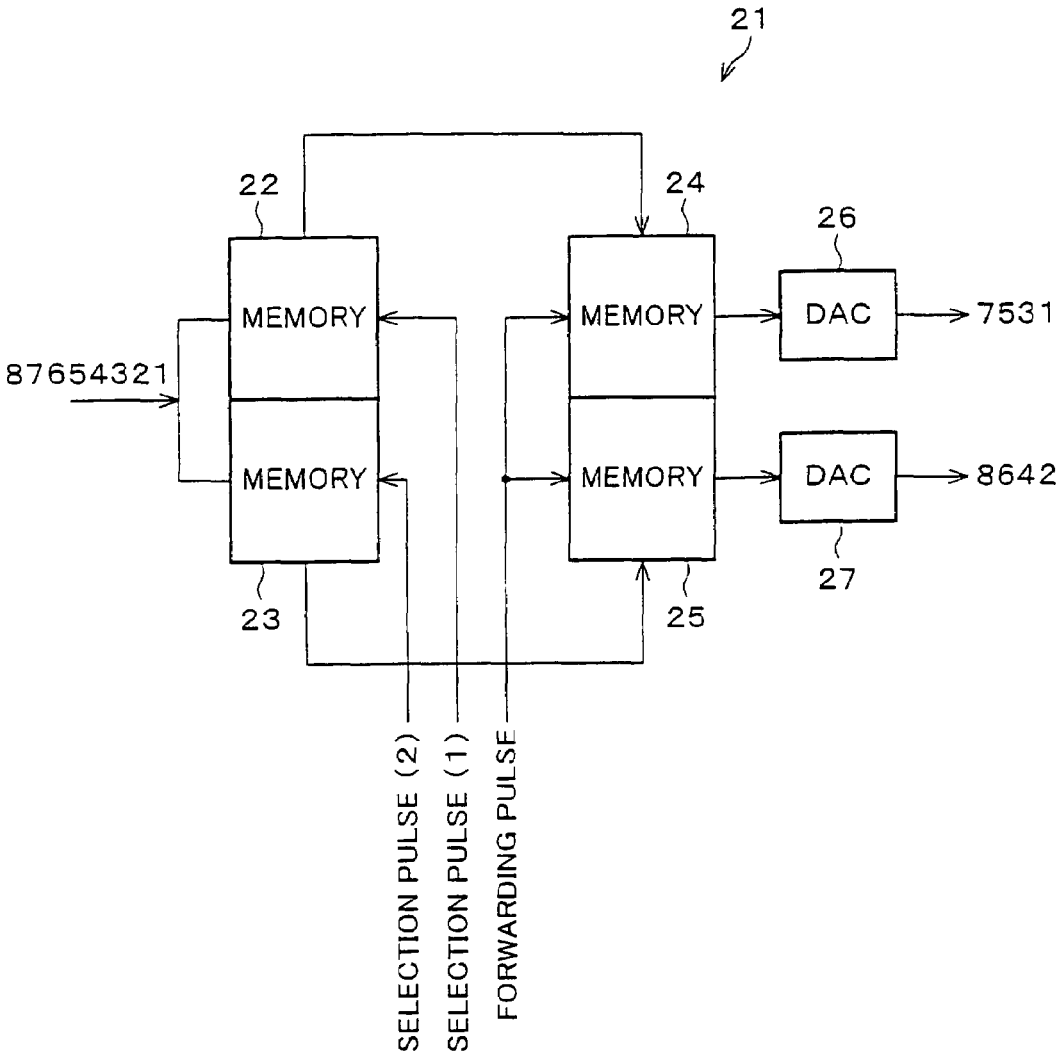
FIG. 11 PRIOR ART
FIG. 11 a block diagram schematically showing a first conversion circuit which converts the signal shown in FIG. 10(*a*) into the signal shown in FIG. 10(*b*).
Figure 12:
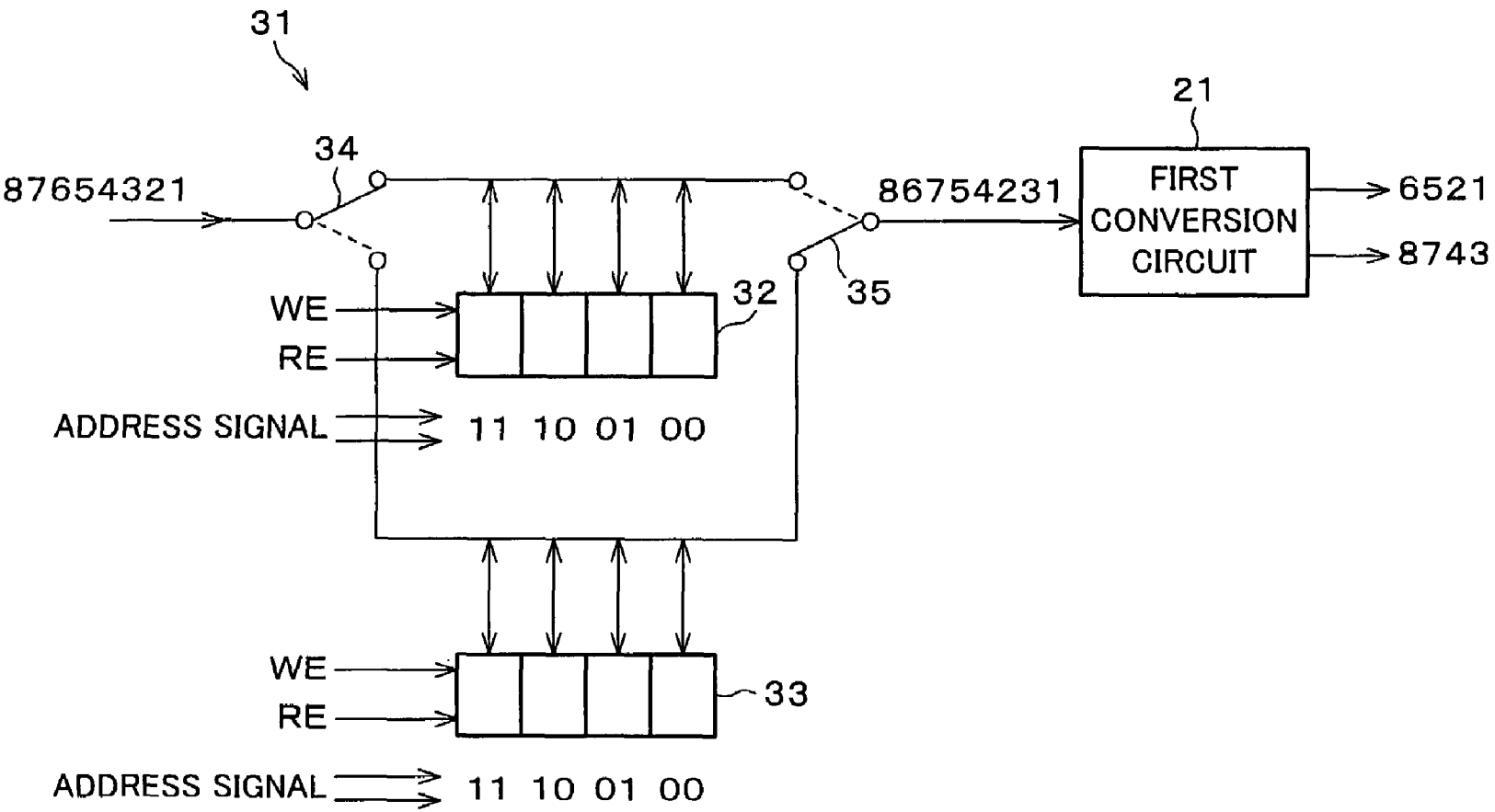
FIG. 12 is a block diagram schematically showing a second conversion circuit which converts the signal shown in FIG. 10(*a*) into the signal shown in FIG. 10(*c*).

Here, generation of the video signal DAT1 and the video signal DAT2 that are inputted to the data signal line driving circuit 3 is described as follows with reference to FIGS. 10(*a*) to 10(*c*) and FIG. 12. FIG. 10(*a*) shows a digital video signal, and FIG. 10(*b*) shows an analog signal which is subjected to ordinary two-phase development, and FIG. 10(*c*) shows an analog signal which is subjected to the two-phase development according to the present embodiment. FIG. 11 is a block diagram schematically showing a circuit for generating the analog signal shown in FIG. 10(*b*), and FIG. 12 is a block diagram schematically showing a circuit for generating the analog signal shown in FIG. 10(*c*).

First, a case where the digital video signal shown in FIG. 10(*a*) is converted into the analog video signal shown in FIG. 10(*b*) is described as follows.

The foregoing conversion is performed by a first conversion circuit 21 shown in FIG. 11. In the first conversion circuit 21, first, eight DATA "1, 2, 3, 4, 5, 6, 7, 8" of the digital video signals are stored in either a memory 22 or a memory 23. For example, each time a selection pulse (1) is inputted to the memory 22, the memory 22 stores the DATA1, 3, 5, and 7 in order. Every time the selection pulse (2) is inputted to the memory 23, the memory 23 stores the DATA2, 4, 6, and 8 in order.

Every time forward pulses are simultaneously inputted to memories 24 and 25, the memories 24 and 25 store the DATA stored in the memories 22 and 23 in order, and the DATA are simultaneously outputted to a DAC (digital/analog conversion circuit) 26 and a DAC 27 at the next stage, and the DATA are subjected to the digital/analog conversion, and analog video signals (1, 3, 5, and 7) are outputted as the video signals DAT1, and analog signals (2, 4, 6, and 8) are outputted as the video signals DAT2.

Figure 24:
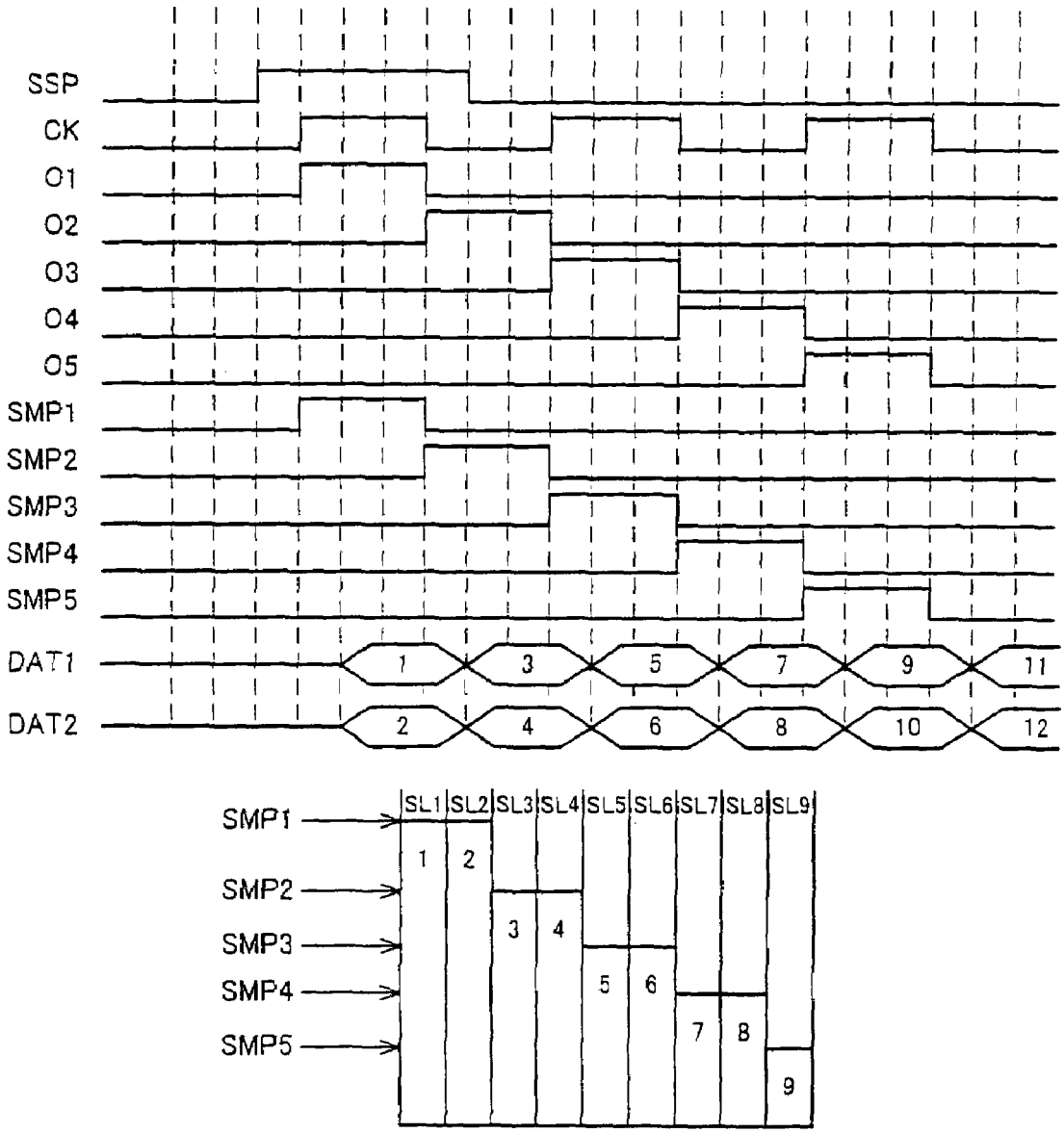
FIG. 24 is a timing chart of various kinds of signals in the case where the high resolution driving is performed in the data signal line driving circuit shown in FIG. 22.

The video signals DAT1 and the video signals DAT2 that have been obtained in the foregoing manner are the same as the video signal DAT1 and the video signal DAT2 that are shown by the timing chart of FIG. 24.

Next, a case where the digital video signal shown in FIG. 10(*a*) is converted into the analog video signal shown in FIG. 10(*c*) is described as follows.

The foregoing conversion is performed by a second conversion circuit 31 shown in FIG. 12. The second conversion circuit 31 includes a conversion circuit, provided at a final stage, which is the same as the aforementioned first conversion circuit, so that description of the conversion is omitted.

The second conversion circuit 31 includes not only the first conversion circuit 21 but also two memories 32 and 33 (temporary storage means) and two switching means 34 and 35.

In the second conversion circuit 31, first, eight DATA "1, 2, 3, 4, 5, 6, 7, and 8" are divided and stored in the memories 32 and 33 via the switching means 34. Further, the DATA are sequentially outputted from the memories via the switching means 35 in accordance with a predetermined rule.

At this time, the DATA are such that "1, 3, 2, 4, 5, 7, 6, and 8". In order to arrange the DATA in this manner, first, the switching means operates so that the DATA are stored in the memory 32, and the DATA are sequentially stored in storage positions (00, 01, 10, 11) in the memory 32, that are indicated by address signals, in accordance with a writing signal WE. Here, the video signal DATA1 is stored in a position 00, and the video signal DATA2 is stored in a position 01, and the video signal DATA3 is stored in a position 10, and the video signal DATA4 is stored in a position 11.

Next, the switching means 34 operates so that the memory 33 stores the signal DATA4, and the DATA 5, 6, 7, and 8 are sequentially stored in storage positions (00, 01, 10, and 11) in the memory 33, that are indicated by the address signal, in accordance with the writing signal WE. Here, the signal DATA5 is stored in a position 00, and the signal DATA6 is stored in a position 01, and the signal DATA7 is stored in a position 02, and the signal DATA8 is stored in a position 11.

Next, the switching means 35 operates so that the DATA stored in the memory 32 are read out in such order that the DATA1, 3, 2, 4, from the storage positions in the memory 32, that are indicated by the address signal, in accordance with a reading signal RE.

Thereafter, the switching means 35 operates so that the DATA stored in the memory 33 are read out in such order that the DATA5, 7, 6, 8, from the storage positions in the memory 33, that are indicated by the address signal, in accordance with the reading signal RE.

Thus, the digital video signals outputted via the switching means 35 are outputted to the first conversion circuit 21 in such order that the DATA1, 3, 2, 4, 5, 7, 6, and 8. In the first conversion circuit, the DATA arranged in order are outputted as video signals which are different from each other, so that the analog video signals outputted from the first conversion circuit 21 are (i) the video signal DAT1 of DATA1, 2, 5, and 6 and (ii) the video signal DAT2 of DATA 3, 4, 7, and 8.

It is possible to use the video signals DAT1 and DAT2 obtained in the foregoing manner as the video signal DAT1 and the video signal DAT2 shown by the timing chart of FIG. 7. Note that, in order to obtain the video signal DAT1 and the video signal DAT2 that are shown by the timing chart of FIG. 9, the second conversion circuit 31 disallows the memory 32 and the memory 33 to store the digital video signals and allows the first conversion circuit 21 to directly store the digital video signals.

According to the data signal line driving circuit 3 arranged in the foregoing manner, when a video signal whose resolution is lower than the maximum resolution (maximum horizontal resolution) is inputted, it is possible to reduce power consumption compared with a conventional data signal line driving circuit. The cause thereof is described as follows.

Figure 22:
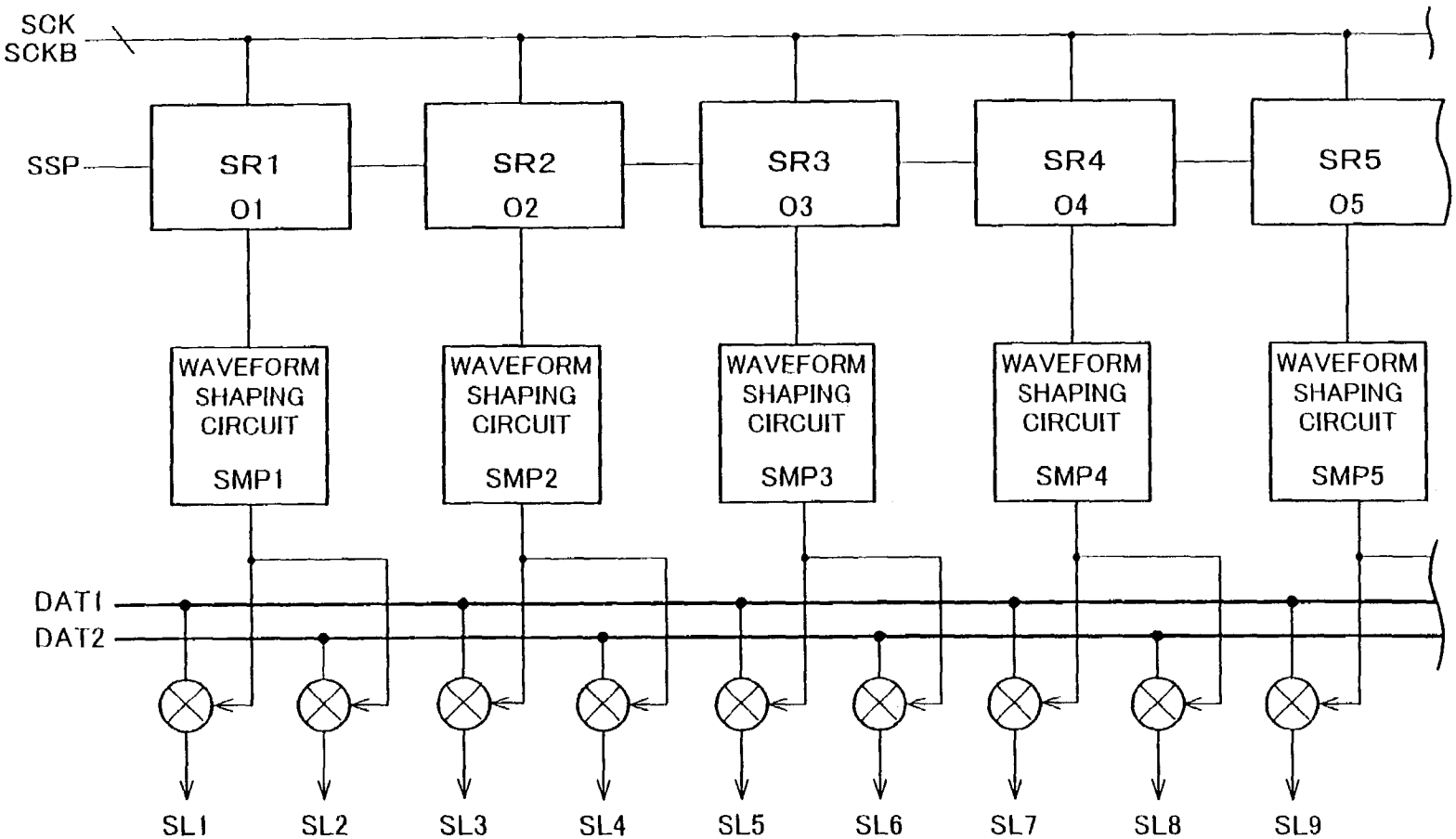
FIG. 22 PRIOR ART
FIG. 22 is a block diagram schematically showing a data signal line driving circuit provided on the image display device shown in FIG. 21.
Figure 23:
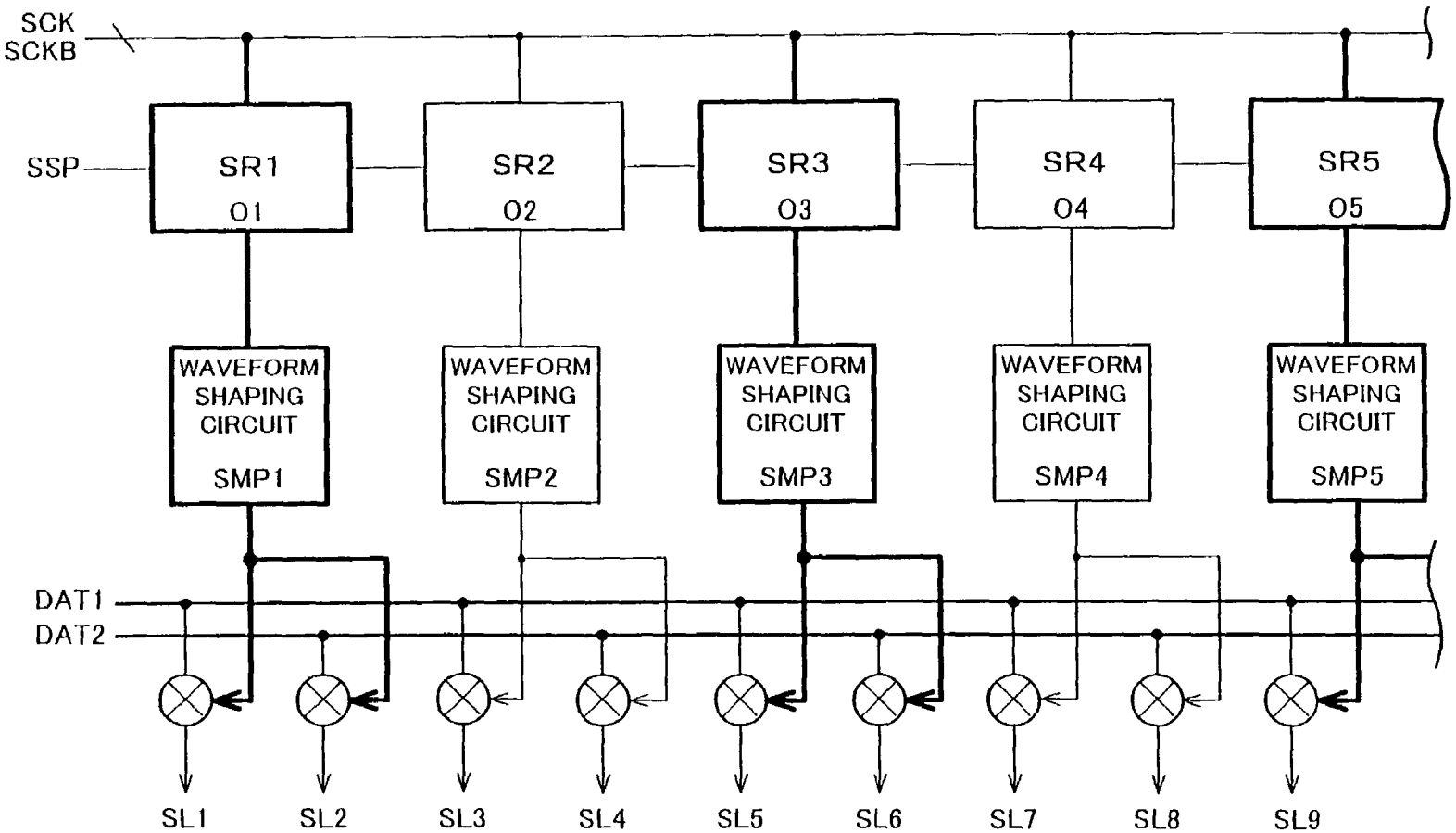
FIG. 23 PRIOR ART
FIG. 23 shows a condition under which high resolution driving is performed in the data signal line driving circuit shown in FIG. 22.

In the data signal line driving circuit 3 according to the present embodiment, when the high resolution driving is performed, as shown in FIG. 6 and FIG. 7, a two-phased video signal (video signal DAT1, video signal DAT2) is inputted, and two-phase development is performed so as to fetch the video signal into the data signal line SL, so that it is possible to reduce the frequency of the video signal to half compared with a case where a video signal that has not been two-phased (video signal of a single phase) is read out and is outputted. Thus, it is not necessary to sample the video signal with high speed, so that it is possible to reduce the operation speed of the shift resister SR. As a result, it is possible to reduce the power consumption of the data signal line driving circuit. As to this point, it is possible to reduce the power consumption also in the conventional data signal line driving circuit shown in FIG. 22 compared with the data signal line driving circuit using a single phase video signal in performing the high resolution driving.

Further, when the low resolution driving is performed, as shown in FIG. 8 and FIG. 9, the two-phased video signal (video signal DAT1, video signal DAT2) is inputted, and the two-phase development is performed so as to fetch the video signal into the data signal line SL as in the high resolution driving. While, the data signal lines SL adjacent to each other sample the same video signal at the same timing, so that the frequency of the video signal is reduced to half compared with the frequency in the case where the high resolution driving is performed. Thus, it is not necessary to sample the video signal with high speed, so that it is possible to reduce the operation speed of the shift resister SR. As a result, it is possible to largely reduce the power consumption of the data signal line driving circuit 3 compared with the case where the high resolution driving is performed.

Further, in the data signal line driving circuit 3 of the present embodiment, when the low resolution driving is performed, the shift resisters SR are controlled so as to operate at every other stage. Thus, in the low resolution driving, the number of operating shift resisters SR is half of the number of the shift resisters SR in performing the high resolution driving, so that it is possible to further reduce the power consumption of the data signal line driving circuit compared with the case of the high resolution driving.

Moreover, by making the foregoing arrangement, it is possible to realize a resolution switching function. Besides, it is possible to obtain the following advantage. In the case of performing the high resolution driving, when a conventional data signal line driving circuit is arranged so that the video signal is fetched into the data signal lines in each block, an end portion of the block and a middle portion of the block are different from each other in terms of influence exerted by the adjacent data signal line, so that a stripe occurs in the end portion of the block in displaying an image. As a result, the display quality is deteriorated. However, according to the aforementioned arrangement, it is possible to uniform the influence that the data signal line receives from the adjacent data signal line in the whole block, thereby preventing the deterioration of the display quality.

Incidentally, in the data signal line driving circuit 3 arranged in the foregoing manner, in order to operate every other shift resister SR in performing the low resolution driving, the switching elements 14 to 16 are provided. Each switching element is generally constituted of a transistor, so that the large number of transistors are required in whole the data signal line driving circuit. As a result, this may result in enlargement of the circuit.

Then, in Embodiment 2, it is impossible to reduce the power consumption compared with Embodiment 1, but it is possible to realize a data signal line driving circuit whose size can be reduced by reducing the number of transistors. Such data signal line driving circuit will be detailed in Embodiment 2.

Embodiment 2

The following description will explain another embodiment of the present invention. Note that, in the present embodiment, the same reference signs are given to members having the same functions as the members described in Embodiment 1, and description thereof is omitted.

Figure 13:
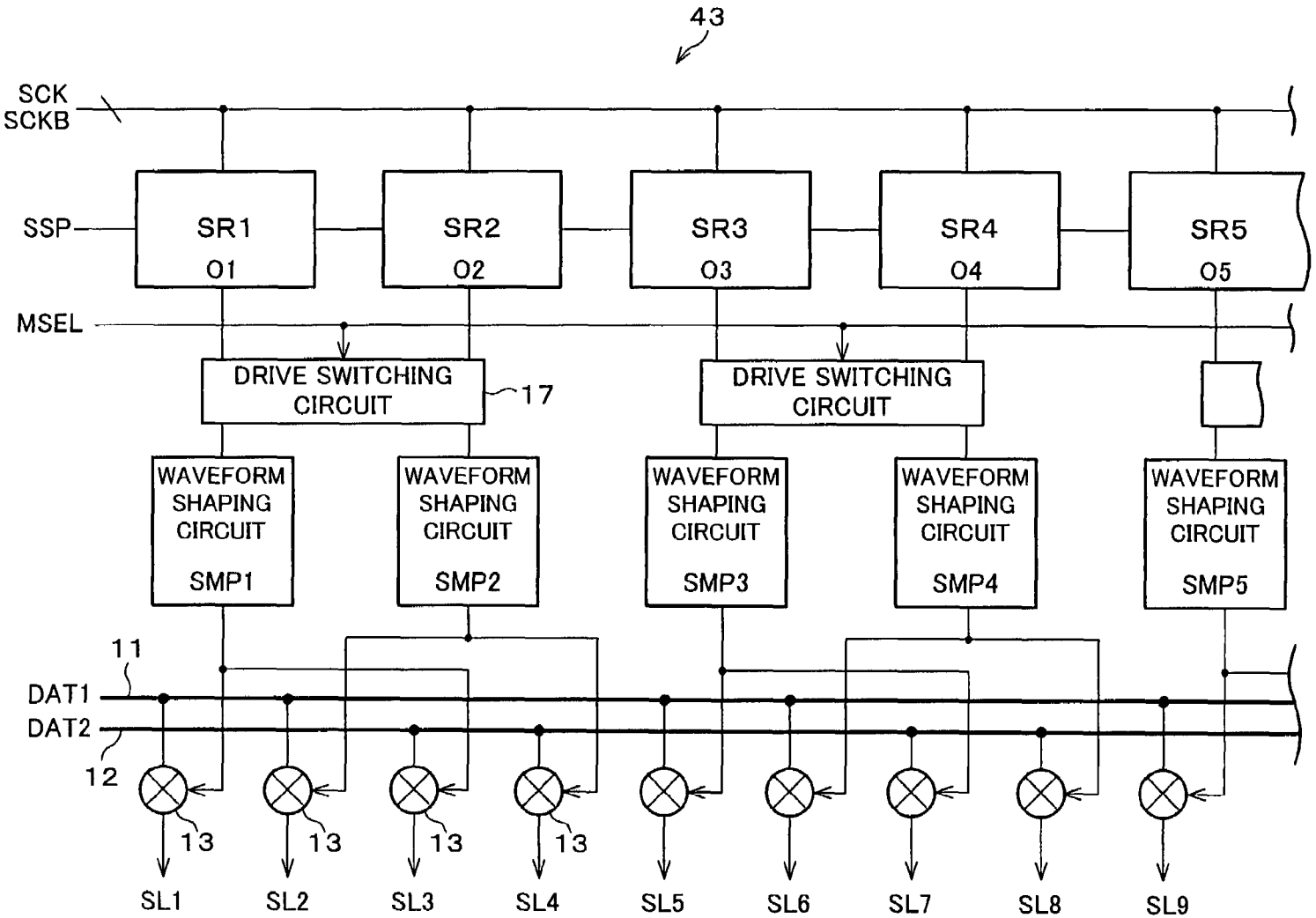
FIG. 13 is a block diagram schematically showing a data signal line driving circuit according to another embodiment of the present invention.

An image display device according to the present embodiment is different from the image display device shown in FIG. 2 of Embodiment 1 in that: instead of the data signal line driving circuit 3, a data signal line driving circuit 43 shown in FIG. 13 is provided.

The data signal line driving circuit 43 is different from the data signal line driving circuit 3 of Embodiment 1 in that the switching element is not provided between the shift resisters SR. Thus, it is possible to reduce the circuit size of the data signal line driving circuit 43 since the transistor constituting the switching element can be omitted.

In the data signal line driving circuit 43, the drive switching circuit 17 is provided as in the data signal line driving circuit 3, and the drive switching control signal MSEL controls an ON/OFF state of the drive switching circuit 17. That is, when the drive switching circuit 17 is ON, an output signal O1 of the shift resister SR1 is inputted to the wave shaping circuit SMP1 and the waveform shaping circuit SMP2, so that an output signal O2 of the shift resister 2 cannot be outputted to the waveform shaping circuit SMP2. Further, when the drive switching circuit 17 is OFF, the output signal O1 of the shift resister SR1 is outputted only to the waveform shaping circuit SMP1, and the output signal O2 of the shift resister SR2 is outputted to the waveform shaping circuit SMP2. As to a relationship between the shift resister SR3 and the shift resister SR4, a receiving end of a signal outputted from the shift resister SR is determined in accordance with an ON/OFF state of the drive switching circuit 17 as in the shift resister SR1 and the shift resister SR2.

Here, (i) operations of the data signal line driving circuit 43 in performing the high resolution driving and (ii) operations of the data signal line driving circuit 43 in performing the low resolution driving are described as follows.

Figure 14:
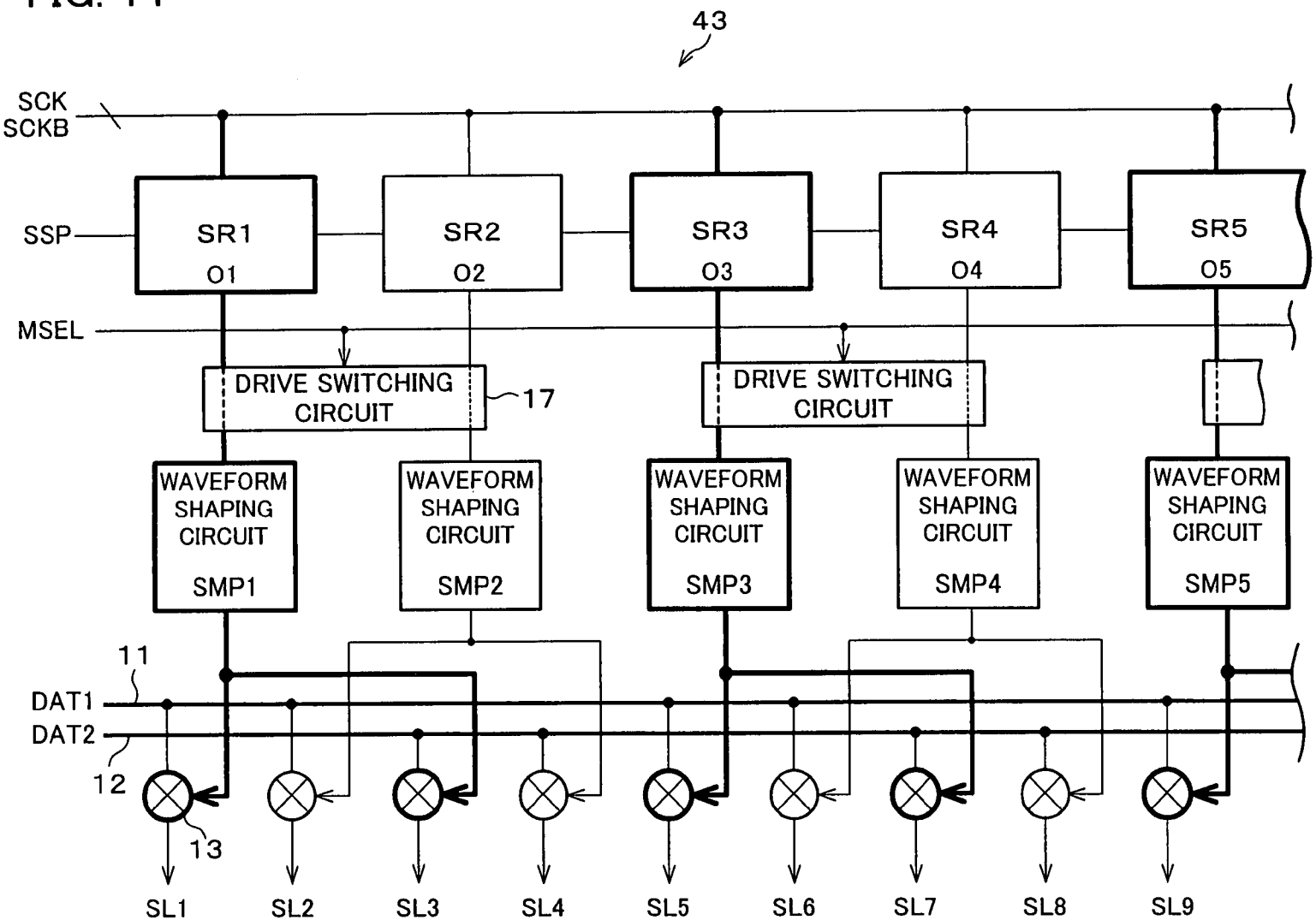
FIG. 14 shows a condition under which high resolution driving is performed in the data signal line driving circuit shown in FIG. 13.

First, the operations of the data signal line driving circuit 43 in performing the high resolution driving are described with reference to FIG. 14 and FIG. 15. FIG. 14 is a block diagram schematically showing the data signal line driving circuit 43, and FIG. 15 is a timing chart of various kinds of signals in the data signal line driving circuit 43 in performing the high resolution driving.

Here, (i) the video signal DAT1 inputted to the video signal line 11 of the data signal line driving circuit 43 and (ii) the video signal DAT2 inputted to the video signal line 12 of the data signal line driving circuit 43 are obtained by converting digital video signals (DATA1, 2, 3, 4, 5, 6, 7, 8, 9, 10, . . . ), each of which is an original signal, after changing an order of the DATA to an order suitable for sampling. The video signal DAT1 and the video signal DAT2 have the same characteristics as in Embodiment 1.

Figure 15:
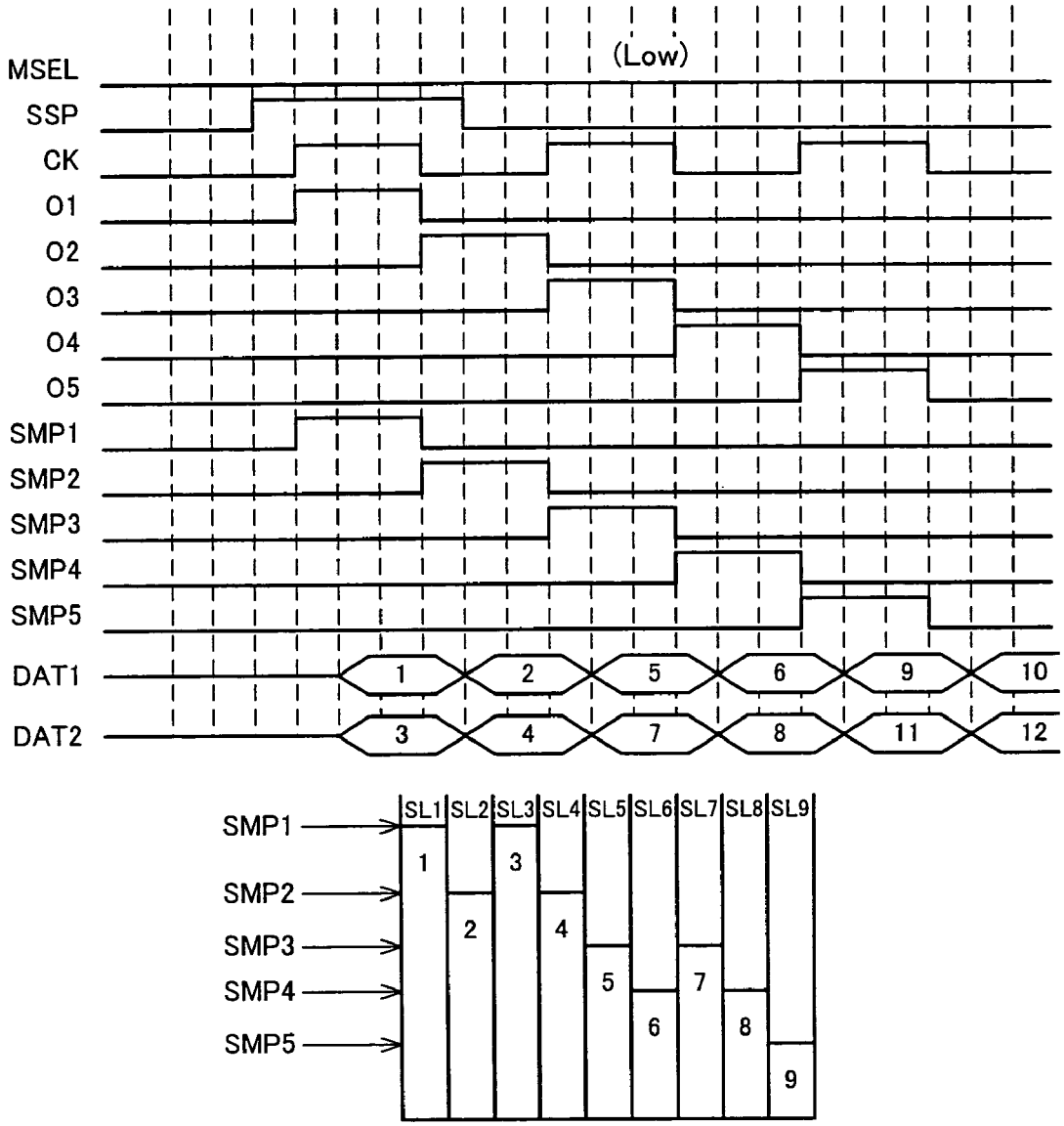
FIG. 15 is a timing chart of various kinds of signals in the case where the high resolution driving is performed in the data signal line driving circuit shown in FIG. 13.

When the high resolution driving is performed, as shown by the timing chart of FIG. 15, a level of the drive switching control signal MSEL is low, so that the drive switching circuit 17 is OFF, and as shown in FIG. 14, output signals from the shift resisters SR are outputted only to corresponding waveform shaping circuits SMP. For example, the output signal O1 of the shift resister SR1 is outputted only to the waveform shaping circuit SMP1, and the output signal O2 of the shift resister SR2 is outputted only to the waveform shaping circuit SMP2, and the output signal O3 of the shift resister SR3 is outputted only to the waveform shaping circuit SMP3, and the output signal O4 of the shift resister SR4 is outputted only to the waveform shaping circuit SMP4.

In this manner, the shift resisters SR are sequentially driven, so that the waveform shaping circuit SMP1 is sequentially driven. As a result, every other data signal line SL is driven at the same time. For example, in FIG. 14, when the shift resister SR1 is driven, a sampling pulse is outputted from the waveform shaping circuit SMP1 and is inputted to the switching elements 13 of the data signal line SL1 and the data signal line SL3, so that the data signal lines SL1 and SL3 are driven at the same time. At this time, the video signal DAT1 flowing in the video signal line 11 is fetched into the data signal line SL1, and the video signal DAT2 flowing in the video signal 12 is fetched into the data signal line SL3. Next, when the shift resister SR2 is driven, a sampling pulse is outputted from the waveform shaping circuit SMP2 and inputted to the switching elements 13 of the data signal line SL2 and the data signal line SL4, so that the data signal lines SL2 and SL4 are driven at the same time.

That is, the shift resister SR1 at the first stage is driven by the start pulse SSP, the clock signals SCK and SCKB (inversion signal of SCK, not shown in FIG. 15), so as to output the signal O1. The output signal O1 is outputted only to the waveform shaping circuit SMP1, and its waveform is shaped by the waveform shaping circuit SMP1, and is transmitted to the switching elements 13 of the data signal line SL1 and the data signal line SL3 as a sampling pulse SMP1, so as to sample (i) DATA1 of the video signal DAT1 flowing in the video signal line 11 and (ii) DATA3 of the video signal DAT2 flowing in the video signal line 12.

Next, the shift resister SR2 at the next stage is driven so as to output the signal O2. The output signal O2 is outputted only to the waveform shaping circuit SMP2, and its waveform is shaped by the waveform shaping circuit SMP2, and is transmitted to the switching elements 13 of the data signal line SL2 and the data signal line SL4 as a sampling pulse SMP2, so as to sample (i) DATA2 of the video signal DAT1 flowing in the video signal line 11 and (ii) DATA4 of the video signal DAT2 flowing in the video signal line 12.

Likewise, the shift resisters SR are sequentially driven, and a portion surrounded by a thick line of FIG. 14 and a portion surrounded by a thin line of FIG. 14 are alternately driven, and the data signal lines SL adjacent to each other are subjected to the sampling at different timings, and every other data signal line SL is subjected to the sampling at the same timing.

That is, as shown in FIG. 15, in accordance with the sampling pulse SMP1, the video signal DAT1 (DATA1) and the video signal DAT2 (DATA3) are simultaneously sampled by the data signal line SL1 and the data signal line SL3. In accordance with the sampling signal SMP2, the video signal DAT1 (DATA2) and the video signal DAT2 (DATA4) are simultaneously sampled by the data signal line SL2 and the data signal line SL4. In the same manner, the video signal DAT1 and the video signal DAT2 are sampled.

In this manner, when the high resolution driving is performed, different DATA are fetched into all of the data signal lines SL1 to SLm, so that it is possible to display an image in the image display device with the maximum resolution (maximum horizontal resolution).

Figure 16:
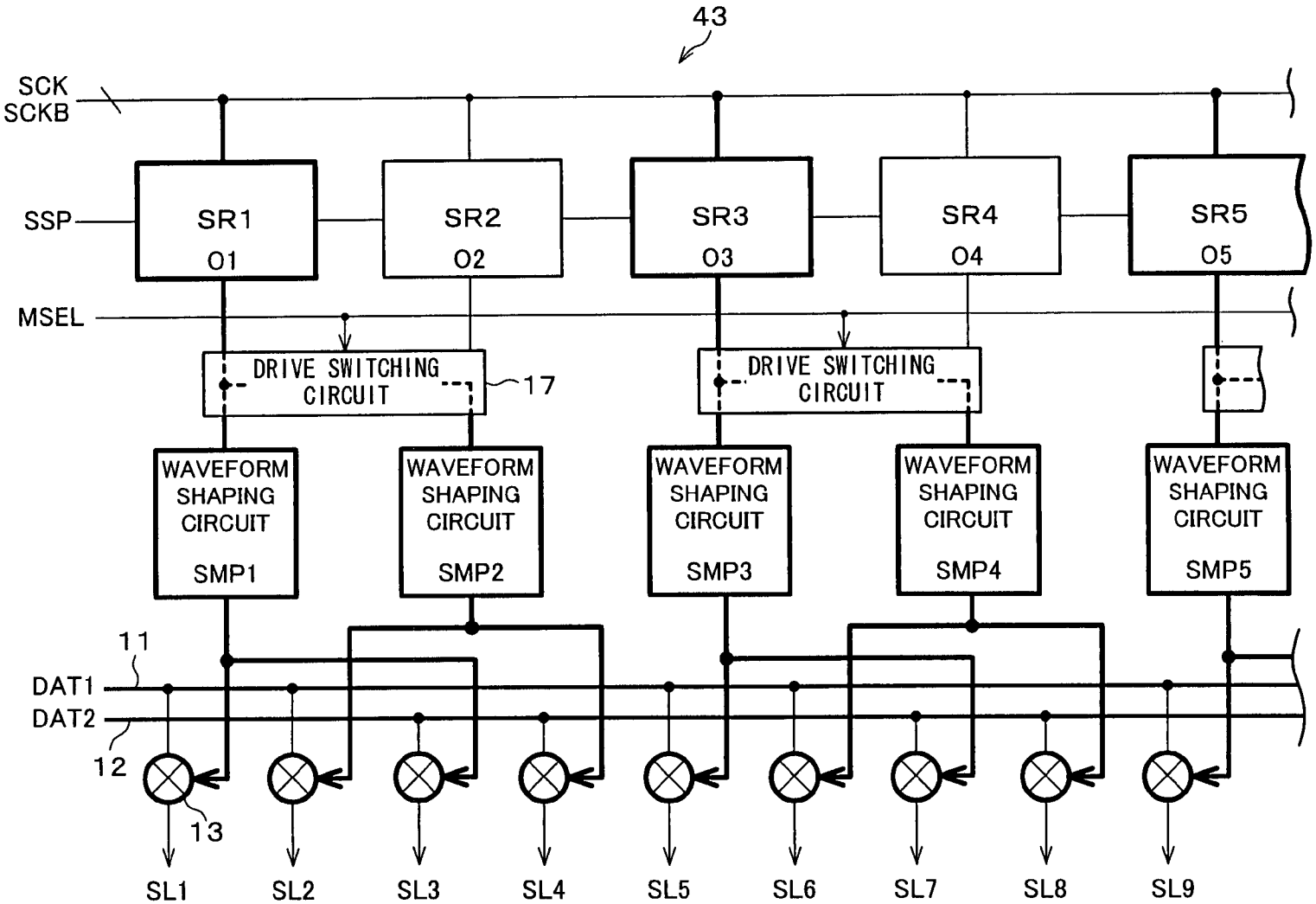
FIG. 16 shows a condition under which low resolution driving is performed in the data signal line driving circuit shown in FIG. 13.

Next, the operations of the data signal line driving circuit 43 in performing the low resolution driving is described with reference to FIG. 16 and FIG. 17. FIG. 16 is a block diagram schematically showing the data signal line driving circuit 43, and FIG. 17 is a timing chart of various kinds of signals in the data signal line driving circuit 43 in performing the low resolution driving.

Here, the video signal DAT1 inputted to the video signal line 11 of the data signal line driving circuit 43 and the video signal DAT2 inputted to the video signal line 12 of the data signal line driving circuit 43 are obtained by converting digital video signals (DATA1, 2, 3, 4, 5, 6, 7, 8, 9, 10, . . . ) each of which is an original signal, into analog signals after changing an order of the DATA to an order suitable for sampling. The video signal DAT1 and the video signal DAT2 have the same characteristics as in Embodiment 1.

Figure 17:
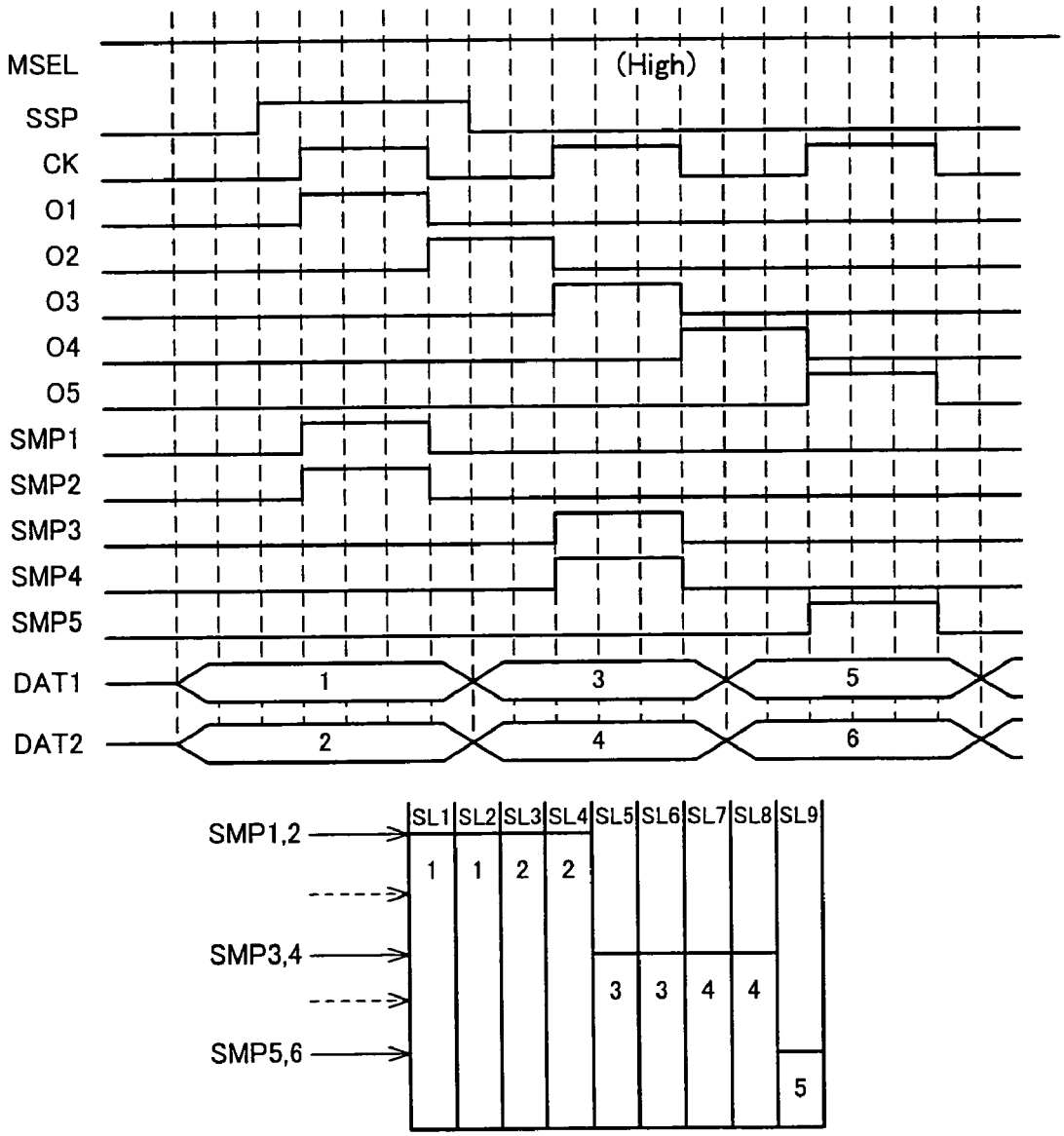
FIG. 17 is a timing chart of various kinds of signals in the case where the low resolution driving is performed in the data signal line driving circuit shown in FIG. 13.

When the low resolution driving is performed, as shown by the timing chart of FIG. 17, a level of the drive switching control signal MSEL is high, so that the drive switching circuits 17 are ON.

Thus, first, the shift resister SR1 at the first stage is driven by the start pulse SSP, and the clock signals SCK and SCKB, so as to output a signal O1. The output signal O1 is outputted to the waveform shaping circuit SMP1 and the waveform shaping circuit SMP2, and its waveform is shaped by the waveform shaping circuit SMP1 and the waveform shaping circuit SMP2, and the output signal O1 is transmitted to the switching elements 13 of the data signal line SL1, the data signal line SL3, the data signal line SL2, and the data signal line SL4, as a sampling pulse SMP1 and a sampling pulse SMP2, and DATA1 of the video signal DAT1 flowing in the video signal line 11 and DATA2 of the video signal DAT2 flowing in the video signal line 12 are sampled. That is, four data signal lines SL are simultaneously driven.

Next, the shift resister SR2 at the next stage is driven so as to output the output signal O2. However, when the low resolution driving is performed, the signal O2 is separated from the waveform shaping circuit SMP2, so that the signal O2 does not contribute to the sampling. Then, the shift resister SR3 at the further next stage is driven so as to output the signal O3. The output signal O3 is outputted to the waveform shaping circuit SMP3 and the waveform shaping circuit SMP4, and its waveform is shaped by the waveform shaping circuits SMP3 and SMP 4, and is transmitted to the switching elements 13 of the data signal line SL5, the data signal line SL7, the data signal line SL6, and the data signal line SL8, as a sampling pulse SMP3 and a sampling pulse SMP4, and DATA3 of the video signal DAT1 flowing in the video signal line 11 and DATA4 of the video signal DAT2 flowing in the video signal line 12 are sampled. Also in this case, four data signal lines SL are simultaneously driven.

Likewise, the shift resisters SR4 and SR5 are driven, and the data signal lines SL, sequentially connected to the same video signal line, which are adjacent to each other, are subjected to the sampling at the same timing so that the sampling pulses SMP5 and SMP6 are generated in accordance with the output signal O5.

That is, as shown in FIG. 17, in accordance with the sampling pulses SMP1 and SMP2, DATA1 of the video signal DAT1 is sampled by the data signal line SL1 and the data signal line SL2, and DATA2 of the video signal DAT2 is sampled by the data signal line SL3 and the data signal line SL4.

In this manner, when the low resolution driving is performed, the same DATA is fetched into every two data signal lines of the data signal lines SL1 to SLm, so that it is possible to display a video signal whose horizontal resolution is half of the maximum resolution (maximum horizontal resolution) of the image display device.

Note that, in the data signal line driving circuit 43, when the low resolution driving is performed, each shift resister SR supplies an output signal to every other waveform shaping circuit SMP, but a shift resister SR which does not supply the output signal to the waveform shaping circuit SMP does not stop operating. Thus, the data signal line driving circuit 43 according to the present embodiment cannot reduce the power consumption in performing the low resolution driving compared with the data signal line driving circuit 3 of Embodiment 1. However, in the data signal line driving circuit 43, as in the data signal line driving circuit 3, the two-phase development is performed in the low resolution driving, and the data signal lines SL adjacent to each other sample the same video signal at the same timing, so that it is possible to reduce the power consumption compared with the case of the high resolution driving.

The foregoing description explains (i) the case where a video signal whose resolution is high is inputted to a display device of high resolution so as to display an image and (ii) the case where a video signal whose resolution is low is inputted to the display device of high resolution so as to appropriately display an image. However, the following description will explain an example where a video signal whose resolution is high is displayed in the display device in accordance with a low resolution display mode which allows a video signal whose resolution is low to be displayed.

Figure 18:
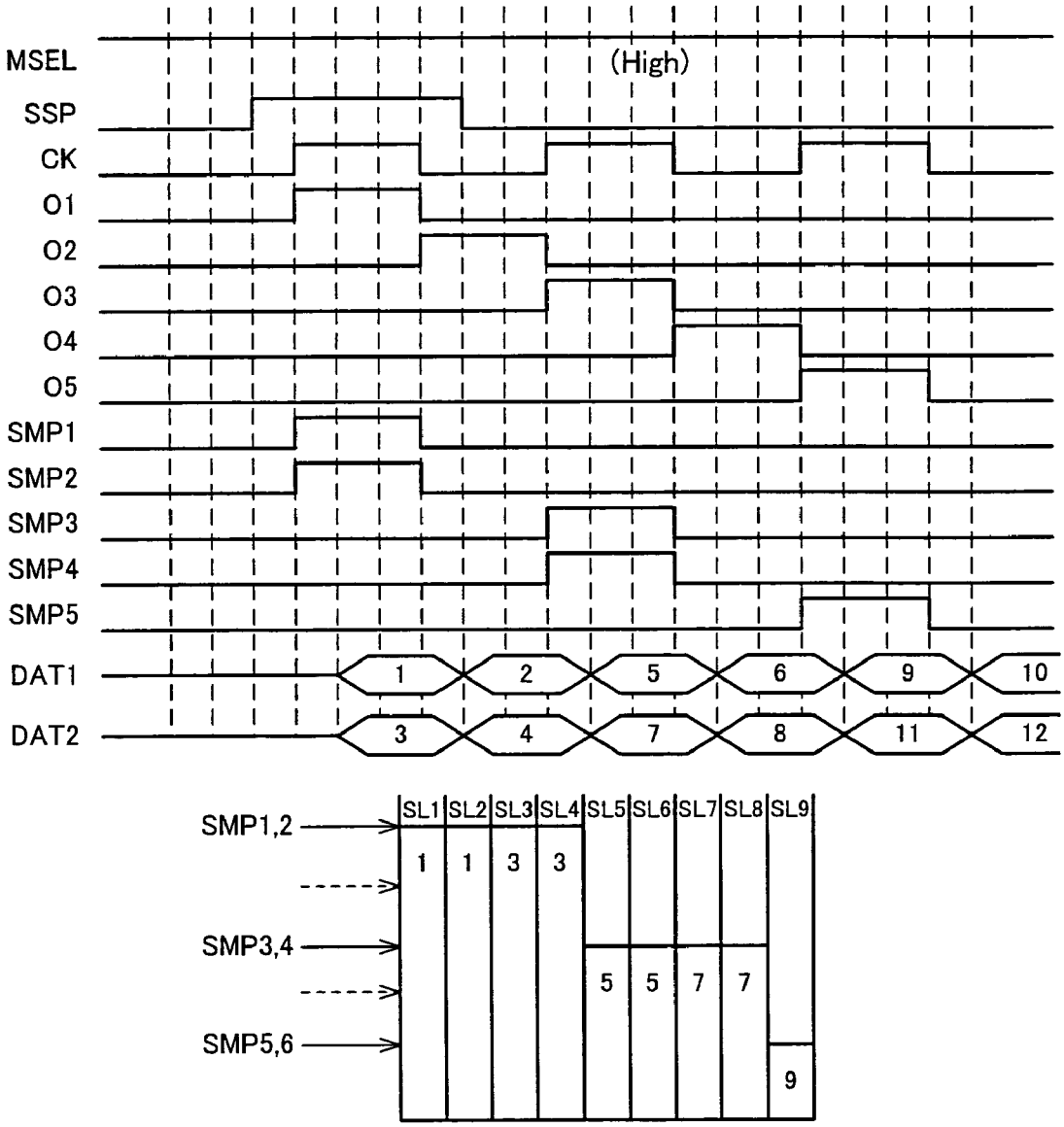
FIG. 18 is another timing chart of various kinds of signals in the case where the low resolution driving is performed in the data signal line driving circuit shown in FIG. 13.

In this case, a level of the drive switching control signal MSEL is high, and the data signal line driving circuit is in the low resolution display mode. However, the resolution of the inputted video signal is high, and the video signals DAT1 and DAT2 are sequentially inputted, so that every other data of the video signal DAT1 and every other data of the video signal DAT2 are selectively outputted as shown in FIG. 18.

In this manner, the video signal whose resolution is high is inputted to the data signal line driving circuit which operates in the low resolution display mode, so that it is not necessary to convert the video signal whose resolution is high into the video signal whose resolution is low in the outside of the data signal line driving circuit, so that it is possible to reduce the circuit size and to reduce the power consumption by making the resolution of the video signal lower.

According to the data signal line driving circuit according to the present embodiment, it is not necessary to change a conventional circuit arrangement required in switching between the high resolution driving and the low resolution driving, and only a connection condition between the data signal line and the video signal line needs to be changed, so that it is possible to perform the multiphase development not only in the high resolution driving but also in the low resolution driving without enlarging the circuit size. Thus, it is possible to reduce the power consumption compared with the conventional data signal line driving circuit.

Here, the following description explains difference among the data signal line driving circuit of Embodiment 1 (FIG. 1), the data signal line driving circuit of Embodiment 2 (FIG. 13), and a conventional data signal line driving circuit (FIG. 22) in terms of the frequency, with reference to Table 1.

Note that, in each data signal line driving circuit, it is assumed that the two-phase development is performed. Further, in each data signal line driving circuit, when the high resolution driving is performed, it is possible to reduce a dot frequency ratio, i.e., it is possible to reduce the frequency of the video signal so as to be 1 with respect to the number of phase developments, so that the dot frequency ratio in the high resolution driving is 1.

As apparent from Table 1, difference occurs among the data signal line driving circuits in terms of the power consumption ratio. The power consumption ratio is such that: high resolution power consumption/low resolution power consumption.

In the data signal line driving circuit shown in FIG. 1, when the low resolution driving is performed, the same video signal is allowed to flow to two data signal lines adjacent to each other while performing the phase development, so that the dot frequency ratio is half of the dot frequency ratio in the high resolution driving. That is, the frequency of the video signal in the low resolution driving is half of the frequency of the video signal in the high resolution driving.

In the data signal line driving circuit shown in FIG. 13, when the low resolution driving is performed, the same video signal is allowed to flow to two data signal lines adjacent to each other while performing the phase development, so that the dot frequency ratio is half of the dot frequency ratio in the high resolution driving as in the data signal line driving circuit shown in FIG. 1. That is, the frequency of the video signal in the low resolution driving is half of the frequency of the video signal in the high resolution driving. However, as shown in FIG. 17, in the data signal line driving circuit shown in FIG. 13, when the low resolution driving is performed, the shift resisters at all the stages do not stop operating as in the high resolution driving. Thus, more power is consumed than that of the data signal line driving circuit shown in FIG. 1. That is, the power consumption ratio is less than the data signal line driving circuit shown in FIG. 1.

Further, in the data signal line driving circuit shown in FIG. 13, when a video signal whose resolution is high is to be displayed in accordance with the low resolution display mode, it is natural that the dot frequency ratio thereof is the same as the dot frequency ratio in the high resolution driving.

Figure 25:
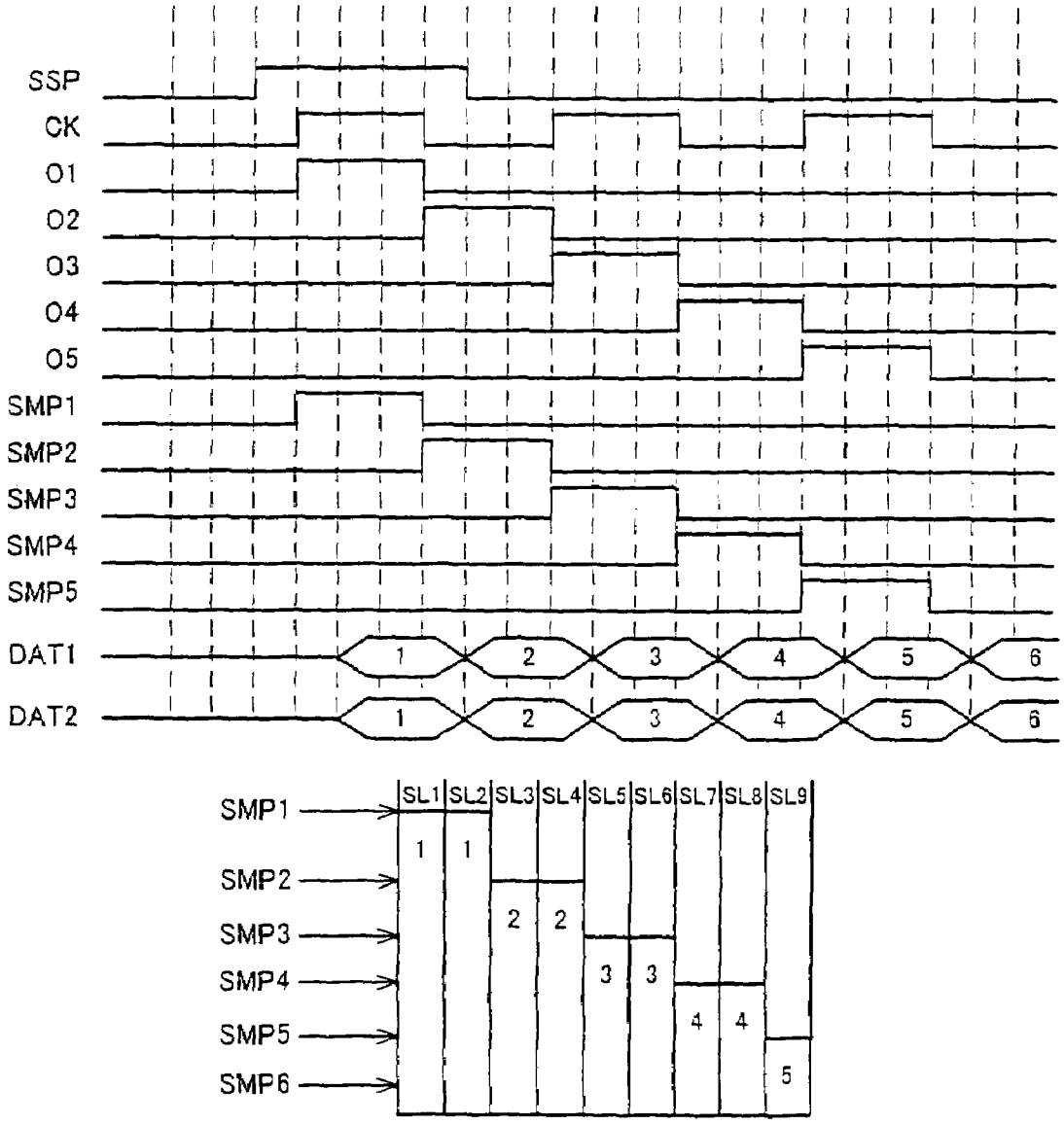
FIG. 25 is a timing chart of various kinds of signals in the case where the low resolution driving is performed in the data signal line driving circuit shown in FIG. 22.

Unlike the two data signal line driving circuits, in the data signal line driving circuit shown in FIG. 22, when the low resolution driving is performed, as shown in FIG. 25, it is necessary to allow the same video signal to flow to two video signal lines, so that it is impossible to perform the two-phase development. Thus, it is impossible to enlarge the dot frequency ratio, so that the dot frequency ratio is the same as the dot frequency ratio in the high resolution driving. As a result, the power consumption ratio is the same as the power consumption ratio in the high resolution driving.

As described above, according to the data signal line driving circuit of the present invention, it is possible to reduce the power consumption in the low resolution driving compared with the high resolution driving.

Embodiment 3

Each of the aforementioned embodiments describes the data signal line driving circuit on the assumption that a monochrome image is displayed, but the arrangement is not limited to this. It is possible to apply the present invention also to a color display based on video signals corresponding to a plurality of color signals, for example, it is possible to apply the present invention also to a data signal line driving circuit for displaying a color image based on three colors of RGB.

Figure 19:
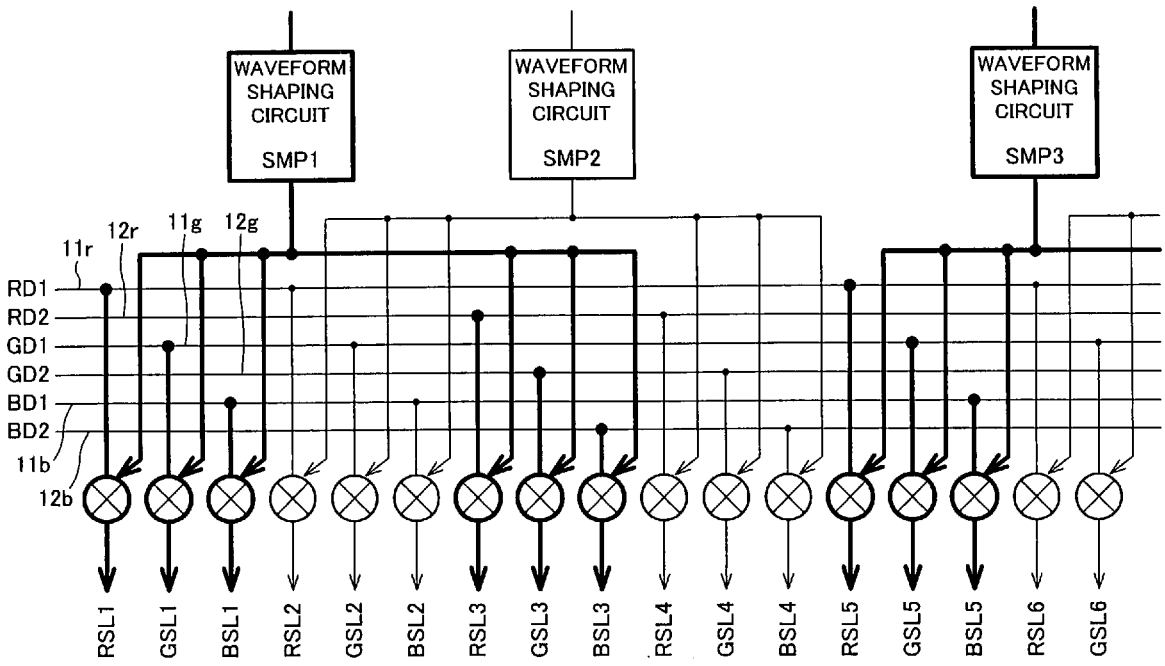
FIG. 19 shows how the video signal lines are connected to the data signal lines in a case where the data signal line driving circuit of the present invention is used in a color display device.
Figure 20:
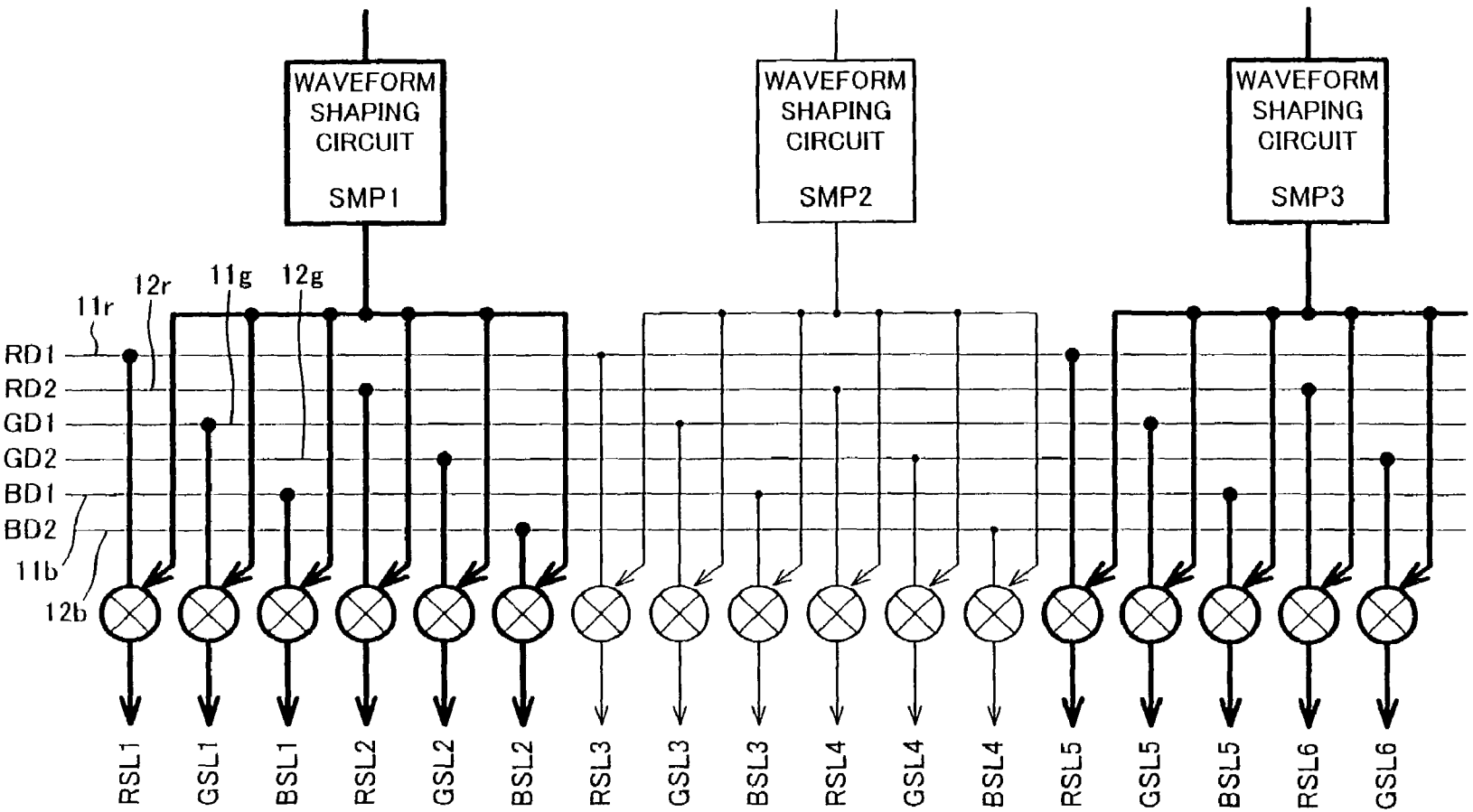
FIG. 20 PRIOR ART
FIG. 20 shows how the video signal lines are connected to the data signal lines in a case where a conventional data signal line driving circuit is used in a color display device.
Figure 21:
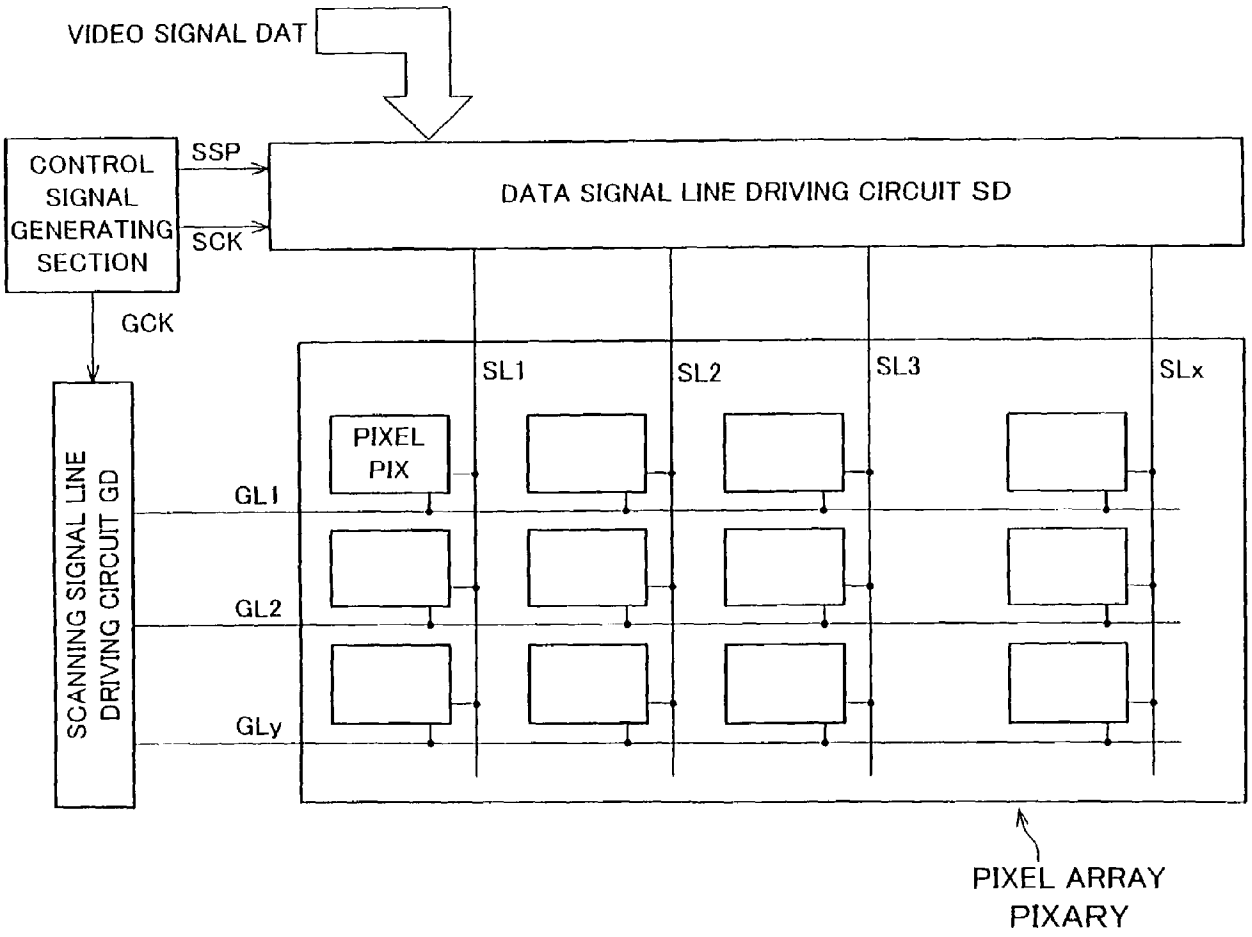
FIG. 21 PRIOR ART
FIG. 21 is a block diagram schematically showing a conventional image display device.

Here, an arrangement of the data signal line applied to the color display is described as follows with reference to FIG. 19 and FIG. 20. FIG. 19 is a block diagram showing an important portion of the data signal line driving circuit to which the present invention is applied, and FIG. 20 is a block diagram showing an important portion of a conventional data signal line driving circuit.

In the data signal line driving circuit to which the present invention is applied, as shown in FIG. 19, three data signal lines for outputting video data of three colors (for example, RGB) constitute a single group. In two groups, adjacent to each other, each of which is constituted of the data signal lines, the data signal lines each of which outputs video data for a first color (for example, red) are connected to the same first color video signal line, and the data signal lines each of which outputs video data for a second color (for example, yellow) are connected to the same second color video signal line, and the data signal lines each of which outputs video data for a third color (for example, blue) are connected to the same third color video signal line. In this case, the two-phase development is performed, so that the two sequential groups of the data signal lines for outputting three color video signals are connected to the same video signal line at intervals of another two groups.

Here, since the two-phase development is performed, the video signals DAT1 and DAT2 that are shown in FIG. 1 are inputted to two video signal lines as in Embodiment 1. However, in the present embodiment, the video signal line covers three color (RGB) signals, so that the video signal line is divided into three corresponding to the three color signals as shown in FIG. 19. A video signal line obtained by dividing the foregoing video signal line is referred to as a "divisional video signal line".

That is, the video signal line DAT1 allows three color signals of RD1, GD1, and BD1 to flow, and the video signal DAT2 allows three color signals of RD2, GD2, and BD2 to flow. Thus, each color signal is inputted to a corresponding divisional video signal line. Here, a color signal RD1 of the video signal DAT1 is inputted to a divisional video signal line 11*r*, and a color signal GD1 of the video signal DAT1 is inputted to a divisional video signal line 11*g*, and a color signal BD1 of the video signal DAT1 is inputted to a divisional video signal 11*b*. Further, a color signal RD2 of the video signal DAT2 is inputted to a divisional video signal line 12*r*, and a color signal GD2 of the video signal DAT2 is inputted to a divisional video signal line 12*g*, and a color signal BD2 of the video signal DAT2 is inputted to a divisional video signal 12*b*.

Thus, the data signal line driving circuit of the present embodiment is arranged so that: a predetermined number of data signal lines are sequentially connected to the divisional video signal lines so as to correspond to the color signals, and the data signal line groups whose number is the same as the number of the video signal lines constitute a single block, and as in Embodiment 1, there is provided a video signal fetching section (waveform shaping circuit SMP1 and the like) which fetches the video signal from the video signal lines into the data signal lines.

In FIG. 19, the data signal lines RSL1 and RSL2 are connected to the divisional video signal line 11*r* which is one of the divisional video signal lines to which the color signals of the video signal DAT1 are inputted, and the data signal lines GSL1 and GSL2 are connected to the divisional video signal line 11*g* which is one of the divisional video signal lines to which the color signals of the video signal DAT1 are inputted, and the data signal lines BGL1 and BGL2 are connected to the divisional video signal line 11*b* which is one of the divisional video signal lines to which the color signals of the video signal DAT1 are inputted, and these six data signal lines constitute a data signal line group.

Further, the data signal lines RSL3 and RSL4 are connected to the divisional video signal line 12*r* which is one of the divisional video signal lines to which the color signals of the video signal DAT2 are inputted, and the data signal lines GSL3 and GSL4 are connected to the divisional video signal line 12*g* which is one of the divisional video signal lines to which the color signals of the video signal DAT2 are inputted, and the data signal lines BGL3 and BGL4 are connected to the divisional video signal line 12*b* which is one of the divisional video signal lines to which the color signals of the video signal DAT2 are inputted, and these six data signal lines constitute a data signal line group.

The two data signal line groups are regarded as a single block. Here, two signal line groups, each constituted of three color data signals, whose number is the same as the number of types of the video signals, are regarded as a single block regarded as a unit in inputting an image.

Thus, the data signal lines for outputting video data corresponding to two data signal line groups each constituted of three color signals fetch the video signals in accordance with signals from different waveform shaping circuits. Here, the data signal line driving circuit shown in FIG. 19 basically operates in the same manner as in the data signal line driving circuits 3 and 43, so that description thereof is omitted.

On the other hand, in the conventional data signal line driving circuit, as shown in FIG. 20, three data signal lines for outputting video data of three colors (for example, RGB) constitute a single group, and in two data signal lines adjacent to each other, data signal lines for outputting first color (for example, red) video data are connected to different first color video signal lines, and data signal lines for outputting second color (for example, green) video data are connected to different second color video signal lines, and data signal lines for outputting third color (for example, blue) video data are connected to different third color video signal lines. In this case, since the two-phase development is performed, the two data signal line groups for outputting video data of three colors are connected to different video signals. Here, the data signal line driving circuit shown in FIG. 20 basically operates in the same manner as in the data signal line driving circuit shown in FIG. 22, so that description thereof is omitted.

Thus, in the case of the data signal line driving circuit shown in FIG. 19, unlike the data signal line driving circuit shown in FIG. 20, the two-phase development is performed in the low resolution driving, and the adjacent two groups of the data signal lines sample the same video signal at the same timing, so that it is possible to reduce the frequency compared with the high resolution driving.

Further, if the shift resister relates to the waveform shaping circuit in the same manner as in the data signal line driving circuit shown in FIG. 1, it is possible to operate only a required shift resister, so that it is possible to further reduce the power consumption.

As described above, according to the present invention, it is possible to reduce the power consumption in the low power driving compared with the case of the high resolution driving regardless of whether the video signal is monochrome or color.

Here, Embodiment 3 describes the case where three color video signals are used, but the three colors are not limited to three colors of red, green, and blue. For example, it is possible to use cyan, magenta, and yellow, or it is possible to use a video signal of four colors, or it is possible to use a video signal of more than four colors.

Note that, each of the aforementioned embodiments describes the case where the two-phase development is performed with respect to a video signal, but it is possible to obtain the same effect by performing development of three or more phases.

Further, the number of the data signal lines connected to the video signal line, i.e., the number of the data signal lines in the data signal line group is two, but it may be so arranged that the number is three or more. For example, if the number of the data signal lines connected to the video signal line is three, it is possible to reduce the maximum resolution (high resolution) of the display section to ⅓.

Further, each of the aforementioned embodiments describes the case where the analog video signal is sampled, but the arrangement is not limited to this. It is possible to make such arrangement that: a digital video signal is sampled, and the sampled video signal is converted into an analog video signal. Also in this case, a multiphased digital video signal is sampled in each of plural video signal lines, and the sampled digital video signal is converted into an analog video signal, and the analog video signal is fetched into plural data signal lines. Thus, such arrangement is included in "driving a plurality of data signal lines respectively so as to fetch a multiphased video signal via a plurality of video signal lines into the data signal lines" recited in claims.

Further, the aforementioned description explains how the resolution of the data signal line driving circuit is converted in the display section. However, originally, the resolution is converted also in the scanning signal line driving circuit. For example, in the case where the display section displays a video signal whose resolution is half of the resolution in the high resolution driving (low resolution), the scanning signal line driving circuit controls the display section so that two scanning signal lines are selected as in the case where two data signal lines are selected.

In this manner, the video signal whose resolution has been converted into half resolution in the data signal line driving circuit, so that the resolution of the displayed image is ¼ of the resolution in the high resolution driving.

Note that, in the aforementioned embodiments, as recited in claims, "driving a plurality of data signal lines respectively so as to fetch a multiphased video signal via a plurality of video signal lines into the data signal lines", and each video signal line has a data signal line group constituted of a predetermined number of the data signal lines sequentially provided, and the data signal line groups, formed on the different video signal lines, whose number is the same as the number of the video signal lines, constitute a single block, and the video signal is fetched from the video signal lines into the data signal lines.

Particularly, as to Embodiment 3, each of the three color video signals becomes a two-phase video signal. In terms of a two-phase video signal obtained by two-phasing one color video signal, the two-phase video signal is fetched into the plural data signal lines via the two video signal lines, and the two data signal lines (of the data signal lines for outputting the corresponding data) sequentially connected to one of the video signals constitute a data signal line group, and the data signal lines, connected to the two video signal lines, whose number corresponds to the two video signal lines, constitute a single block, and the video signal is fetched from the video signal lines into the data signal lines. The foregoing process is performed with respect to another two color video signals. As to Embodiment 3, claims are limitedly recited as follows: each of the data line groups in the block is constituted of a predetermined number of the data signal lines each of the data signal line groups is made up of a predetermined number of sets of the data signal lines corresponding to colors contained in the video signal fetched into the data signal lines.

A matrix type image display device having the data signal line driving circuit of the present invention may be arranged so as to include: a display section, including (i) a plurality of pixels disposed in a matrix manner, (ii) a plurality of data signal lines disposed on rows of the pixels, (iii) a plurality of scanning signal lines disposed so as to correspond to the pixels, said display section fetching a video signal for displaying an image in the pixels from the data signal lines into the pixels in synchronism with a scanning signal supplied from the scanning signal lines, so as to retain the video signal; a data signal line driving circuit for outputting the video signal to the data signal lines in synchronism with a predetermined timing signal; and a scanning signal line driving circuit for outputting the scanning signal to the scanning signal lines in synchronism with a predetermined timing signal, wherein: the multiphased video signal is supplied to the data signal lines via a plurality of video signal lines, and the data signal line driving circuit which can vary a horizontal resolution of the displayed image.

In this case, by providing the foregoing characteristics, it is possible to obtain a highly versatile panel, which can vary its resolution depending on the use, at low cost.

Further, in the image display device, it may be so arranged that: the data signal line driving circuit fetches a multiphased video signal from the video signal lines to the data signal lines in each block, and in the block, a signal line set constituted of plural signal lines adjacent to each other or each signal line are driven at a timing different from a timing at which an adjacent signal line set or an adjacent signal line are driven.

In this case, by making the foregoing arrangement, it is possible to realize a resolution switching function. Further, generally, there is the following problem: when it is so arranged that the video signal is fetched into the data signal lines in each block in the high resolution driving, an end portion of the block and a middle portion of the block are different from each other in terms of influence exerted by the adjacent data signal line, so that a stripe occurs in the end portion of the block in displaying an image, thereby deteriorating the display quality. However, in the case of the foregoing arrangement, it is possible to uniform the influence that the data signal line receives from the adjacent data signal line in the whole block, thereby preventing the deterioration of the display quality.

Further, the image display device may be arranged so that: the data signal line driving circuit fetches data from the video signal lines into the data signal lines in each block, and in the block, it is possible to arbitrarily switch between (i) driving in which a signal line set constituted of plural signal lines adjacent to each other or each signal line of a signal line set is driven at a timing different from a timing at which a signal line set adjacent to that signal line set or each signal line adjacent to that each signal line is driven and (ii) driving in which: data is fetched from the video signal lines into the data signal lines as a block unit, and a signal line set constituted of plural signal lines adjacent to each other or each signal line is driven in the block at the same timing as a timing at which a signal line set adjacent to that signal line set or each signal line adjacent to that each signal line is driven.

In this case, by switching the timing at which a signal line set constituted of plural signal line adjacent to each other or respective signal lines are driven, the horizontal resolution is switched. That is, the resolution switching function is realized.

Further, the data signal line driving circuit may be arranged as follows. There are two cases: (i) the case where the signal line set constituted of plural signal lines adjacent to each other is driven at a timing different from a timing at which a signal line set adjacent to that signal line set is driven, and (ii) the case where each signal line is driven at a timing different from a timing at which a signal line adjacent to that signal line is driven. In the case (i), two or more signal lines, collected from one signal line set and another signal line set adjacent to that signal line set, which are driven at different timings, are connected to the common signal line. In the case (ii), two or more signal lines, adjacent to each other, which are driven at different timings, are connected to the common signal line.

In this case, by providing the foregoing characteristics, it is possible to write the same data on one to two or more data signal lines at the same timing. That is, it is possible to easily realize the low resolution display.

Further, the data signal line driving circuit may be arranged so that: upon performing the aforementioned switching operation, it is possible to vary the number of driving circuits in the shift resister for generating a timing pulse which causes the video signal to be fetched from the video signal lines into the data signal lines.

In this case, by providing the foregoing characteristics, it is possible to vary the condition of the data signal line driving section depending on the display resolution, thereby optimizing the display condition. As a result, it is possible to obtain such advantage that a margin in the circuit operation is enlarged and the driving frequency is reduced.

Further, the data signal line driving circuit is characterized in that: a circuit for generating a timing pulse which causes the video signal to be fetched from the video signal lines into the data signal lines partially stops operation when the switching operation is performed so as to drive a signal line set constituted of plural signal lines adjacent to each other or each signal line at the same timing as a timing at which a signal line set adjacent to that signal line set or another signal line adjacent to that signal line is driven.

In this case, by providing the foregoing characteristics, it is possible to vary the condition of the data signal line driving section depending on the display resolution, thereby making the driving section smaller in an optimizing manner. As a result, it is possible to reduce the power consumption of the circuit according to the display resolution.

Further, the data signal line driving circuit may be arranged so that: a phase development number of the video signal that is externally inputted is not varied when the data signal line driving circuit varies a horizontal resolution of a displayed image by means of the drive switching function.

In this case, by providing the foregoing characteristics, it is possible to effectively use the video signal line, provided so as to perform the high resolution driving, also in performing the low resolution driving. As a result, it is possible to reduce the driving frequency and the power consumption of the data signal line driving circuit.

Further, the data signal line driving circuit may be arranged so that: a frequency of a control signal, inputted from an outside, which controls the data signal line driving circuit, is varied upon performing the switching operation.

In this case, it is possible to suppress the power consumption of the data signal line driving circuit or the power consumption of an external circuit for generating a control signal of the data signal line driving circuit or the scanning signal line driving circuit according to the display resolution.

Further, the image display device may be arranged so that: the data signal line driving circuit, the scanning signal line driving circuit, and the pixel are formed on the same substrate.

In this case, by forming the data signal line driving circuit having the foregoing functions on the substrate where the scanning signal line driving circuit and the pixel are formed, it is possible to reduce the installation cost and to improve the reliability.

Further, the image display device may be arranged so that: an active element which constitutes each of the data signal line driving circuit, the scanning signal line driving circuit, and the pixel is made of a polycrystalline silicon thin film transistor.

In this case, by using the polycrystalline silicon thin film transistor as the active element, it is possible to form the driving circuits and the pixel on the same substrate in accordance with the same process, thereby reducing the manufacturing cost.

Further, the image display device may be arranged so that: the active element is formed on a glass substrate in accordance with a process performed at not more than 600° C.

In this case, it is possible to use an inexpensive glass substrate whose melting point is low, thereby providing the image display device at lower cost.

As described above, the data signal line driving method of the present invention, whereby driving a plurality of data signal lines respectively so as to fetch a multiphased video signal via a plurality of video signal lines into the data signal lines, includes the steps of: gathering data signal line groups, each made up of a predetermined number of the data signal lines sequentially connected to each of the video signal lines, whose number is the same as the number of the video signal lines, said data signal line groups being regarded as a single block; and fetching the video signal from the video signal lines into the data signal lines in each block.

Therefore, the video signal is fetched from the video signal lines into the data signal lines in each block, so that the video signal is fetched from the video signal lines, different from each other, into the data signal line groups.

Thus, even if each data signal line of one of the data signal line groups in each block is driven at the same timing as a timing at which each data signal line of another one of the data signal line groups in each block, or even if all the data signal lines of the data signal line groups are driven at the same timing, it is possible to forward video signals different from each other to the video signal lines (multiphase development), so that it is possible to suppress the power consumption in the low resolution driving compared with the case of the high resolution driving.

Further, in the case where the video signal contains a plurality of color signals, it is possible to carry out the following data signal line driving method.

That is, the data signal line driving method of the present invention, whereby driving a plurality of data signal lines respectively so as to (i) multiphase a video signal having a plurality of color signals and (ii) fetch the video signal into the data signal lines, said method includes the steps of: causing a plurality of divisional video signal lines, divided so as to respectively correspond to the color signals, to constitute each of the video signal lines; gathering data signal line groups, each made up of a predetermined number of the data signal lines sequentially connected to each of the divisional video signal lines so as to respectively correspond to the color signals, whose number is the same as the number of the video signal lines, said data signal line group being regarded as a single block; and fetching the video signal from the video signal lines into the data signal lines in each block.

Also in this case, it is possible to forward video signals different from each other to the video signal lines (multiphase development), so that it is possible to suppress the power consumption in the low resolution driving compared with the case of the high resolution driving.

Further, as described above, the data signal line driving circuit of the present invention, which drives a plurality of data signal lines respectively so as to fetch a multiphased video signal via a plurality of video signal lines into the data signal lines, includes: data signal line groups, each made up of a predetermined number of the data signal lines sequentially connected to each of the video signal lines; and a video signal fetching section for fetching the video signal from the video signal lines into the data signal lines in each block when the data signal line groups, connected to each of the video signal lines, whose number is the same as the number of the video signal lines, are gathered as a single block.

According to the arrangement, the video signal fetching section fetches the video signal from the video signal lines into the data signal lines in each block, so that the video signal is fetched from the video signal lines, different from each other, into the data signal line groups.

Thus, even if each data signal line of one of the data signal line groups in each block is driven at the same timing as a timing at which each data signal line of another one of the data signal line groups in each block, or even if all the data signal lines of the data signal line groups are driven at the same timing, it is possible to forward video signals different from each other to the video signal lines (multiphase development), so that it is possible to suppress the power consumption in the low resolution driving compared with the case of the high resolution driving.

Further, in the case where the video signal contains a plurality of color signals, it is possible to use the following data signal line driving circuit.

That is, the data signal line driving circuit of the present invention, which drives a plurality of data signal lines respectively so as to (i) multiphase a video signal having a plurality of color signals and (ii) fetch the video signal into the data signal lines, includes: a plurality of divisional video signal lines, divided so as to respectively correspond to the color signals, which constitute each of the video signal lines; and a video signal fetching section for fetching the video signal from the video signal lines into the data signal lines in each block when gathering data signal line groups, each made up of a predetermined number of the data signal lines sequentially connected to each of the divisional video signal lines so as to respectively correspond to the color signals, whose number is the same as the number of the video signal lines, said data signal line group being regarded as a single block.

Also in this case, it is always possible to forward the video signals different from each other to the video signal lines (polyphsae development), so that it is possible to suppress the power consumption in the low resolution driving compared with the case of the high resolution driving.

It may be so arranged that: the video signal fetching section includes drive switching means for switching between (i) first driving in which each of the data signal lines of one of the data signal line groups in the block and each of the data signal lines of another one of the data signal line groups in the block are driven at the same time and (ii) second driving in which all the data signal lines of the data signal line groups are driven at the same time.

In this case, by providing the drive switching means for arbitrarily switching between (i) first driving in which each of the data signal lines of one of the data signal line groups in the block and each of the data signal lines of another one of the data signal line groups in the block are driven at the same time (high resolution driving) and (ii) second driving in which all the data signal lines of the data signal line groups are driven at the same time (low resolution driving), it is possible to realize a function for arbitrarily switching the resolution of the signal fetched into the data signal lines.

Thus, in the case where a video signal whose resolution is high is fetched into the data signal lines for example, it is general to employ the first driving in which each of the data signal lines of one of the data signal line groups in the block and each of the data signal lines of another one of the data signal line groups in the block are driven at the same time, but it is possible to fetch the video signal whose resolution is high into the data signal lines by employing the second driving in which all the data signal lines of the data signal line groups are driven at the same time.

It may be so arranged that: the video signal fetching section includes one or more shift resisters for generating a timing pulse causing the video signal to be fetched from the video signal lines to the data signal lines, and the drive switching means switches between the first driving and the second driving so that the number of the shift resisters that operate is varied in switching between the first driving and the second driving.

In this case, the first driving is different from the second driving in terms of the number of the shift resisters that operate, so that it is possible to optimize the power consumption in each driving. For example, in the case where each of the data signal lines of one of the data signal line groups in the block and each of the data signal lines of another one of the data signal line groups in the block are driven at the same time like the first driving, it is necessary to operate as many shift resisters as the number of the data signal line groups in the block, but in the case where all the data signal lines of the data signal line groups are driven at the same time like the second driving, only a single shift resister is required to operate. In such case, the number of the operating shift resisters is varied between the first driving and the second driving, so that it is not necessary to operate the shift resister which is not required in driving the data signal lines, thereby reducing the power consumption.

Specifically, it may be so arranged that: the video signal fetching section includes stopping means for stopping operation of the shift resister which is not required in driving the data signal lines after switching the drive switching means between the first driving and the second driving.

Further, it may be so arranged that: the data signal line groups are data signal line sets each of which is made up of a predetermined number of the data signal lines corresponding to color signals contained in the video signal fetched into the data signal lines.

In this case, when the video signal corresponds to a color image, the number of colors is generally three, and three data signal lines of RGB are regarded as a single set, and when the video signal corresponds to a monochrome image, the number of colors is 1, and a single data signal line is regarded as a single set. Thus, even in the case of a color image or in the case of a monochrome image, it is possible to suppress the power consumption in the low resolution driving compared with the case of the high resolution driving. As a result, it is possible to reduce the power consumption of the data signal line driving circuit.

As described above, the display device of the present invention includes: a display panel which includes (i) a plurality of data signal lines, (ii) a plurality of scanning signal lines provided so as to cross the data signal lines, and (iii) pixels provided on intersections of the data signal lines and the scanning signal lines, a video signal for displaying an image being fetched from the data signal lines into the pixels in synchronism with a scanning signal supplied from the scanning signal lines, said video signal being retained; a data signal line driving circuit for outputting the video signal to the data signal lines in synchronism with a predetermined timing signal; and a scanning signal line driving circuit for outputting the scanning signal to the scanning signal lines in synchronism with a predetermined timing signal, said video signal being multiphased, and being supplied to the data signal lines via a plurality of video signal lines, wherein any one of the aforementioned data signal line driving circuits is used as the data signal line driving circuit.

Therefore, even when the resolution of the video signal is high or even when the resolution of the video signal is low, it is possible to display an image in accordance with the multiphase development, so that it is possible to suppress the power consumption in the low resolution driving compared with the case of the high resolution driving. As a result, it is possible to reduce the power consumption of whole the display device.

Moreover, in the case of performing the high resolution driving, when a conventional data signal line driving circuit is arranged so that the video signal is fetched into the data signal lines in each block, an end portion of the block and a middle portion of the block are different from each other in terms of influence exerted by the adjacent data signal line, so that a stripe occurs in the end portion of the block in displaying an image. As a result, the display quality is deteriorated. However, according to the aforementioned arrangement, it is possible to uniform the influence that the data signal line receives from the adjacent data signal line in the whole block, thereby preventing the deterioration of the display quality.

It may be so arranged that: the data signal line driving circuit, the scanning signal line driving circuit, and the pixel are formed on the same substrate.

In this manner, the data signal line driving circuit, the scanning signal line driving circuit, and the pixel are formed on the same substrate, so that it is possible to reduce the installation cost and to improve the reliability.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A data signal line driving method where n, n>1, video signal lines supply a multiphased video signal in parallel to m, m>1, data fetching blocks, each data fetching block fetching the multiphased video signal into n data line groups and each data line group including p, p>1, sequential data signal lines and driving p corresponding sequentially adjoining sections of a display, the data signal lines each having an associated sampling switch that connects each data signal line to a video signal line such that the p sequential data signal lines of each data line group are connected to the same video signal line and p sequential data signal lines are alternately connected to the same video signal line with an interval of another ((n−1)×p) data signal lines therebetween, the p sampling switches associated with a given data line group each responsive to a different sampling pulse, and p shift registers provided with respect to each data fetching block with the shift registers being connected between blocks such that the blocks are driven sequentially, said method comprising:

fetching the multiphased video signal from the video signal lines, via p sampling pulses, into the data signal lines in each block in response to one or more timing pulses generated by the p shift registers provided with respect to the block, and driving the blocks sequentially, there being performed a first driving in which the p shift registers in each block are driven sequentially to provide p sequential timing pulses and each sampling pulse in the block being responsive to a corresponding timing pulse such that the sampling pulses in the block are activated sequentially, and there being performed a second driving in which only one shift register in the block is driven to provide one timing pulse and all sampling pulses in the block are responsive to the one timing pulse such that all sampling pulses in the block are activated simultaneously.

2. A data signal line driving method where n, n>1, video signal lines supply a multiphased video signal having a plurality of color signals in parallel to m, m>1, data fetching blocks, each data fetching block fetching the multiphased video signal into n data line groups and each data line group including p, p>1, sequential data signal lines and driving p corresponding sequentially adjoining sections of a display, the data signal lines each having an associated sampling switch that connects each data signal line to a video signal line such that the p sequential data signal lines of each data line group are connected to the same video signal line and p sequential data signal lines are alternately connected to the same video signal line with an interval of another ((n−1)×p) data signal lines therebetween, the p sampling switches associated with a given data line group each responsive to a different sampling pulse, and p shift registers provided with respect to each data fetching block with the shift registers being connected between blocks such that the blocks are driven sequentially, each video signal line including a plurality of divisional video signal lines divided so as to respectively correspond to the color signals and each data signal line including a corresponding plurality of divisional data signal lines, said method comprising:

fetching the multiphased video signal from the video signal lines, via p sampling pulses, into the data signal lines in each block in response to one or more timing pulses generated by the p shift registers provided with respect to the block, and driving the blocks sequentially, there being performed a first driving in which the p shift registers in each block are driven sequentially to provide p sequential timing pulses and each sampling pulse in the block being responsive to a corresponding timing pulse such that the sampling pulses in the block are activated sequentially, and there being performed a second driving in which only one shift register in the block is driven to provide one timing pulse and all sampling pulses in the block are responsive to the one timing pulse such that all sampling pulses in the block are activated simultaneously.

3. A data signal line driving circuit, which drives a plurality of data signal lines respectively so as to fetch a multiphased video signal supplied via n, n>1, video signal lines into the data signal lines, comprising:

m, m>1, data fetching blocks configured to receive a multiphased video signal supplied in parallel to the data fetching blocks by the video signal lines;

each data fetching block configured to fetch the multiphased video signal into n data line groups and each data line group including p, p>1, sequential data signal lines and driving p corresponding sequentially adjoining sections of a display;

a plurality of sampling switches, each sampling switch connecting a data signal line to a video signal line such that the p sequential data signal lines of each data line group are connected to the same video signal line and p sequential data signal lines are alternately connected to the same video signal line with an interval of another ((n−1)×p) data signal lines therebetween, the p sampling switches associated with a given data line group each configured to be responsive to a different sampling pulse;

p shift registers provided with respect to each data fetching block, the shift registers being connected between blocks such that the blocks are driven sequentially;

a sampling pulse generating section provided with respect to each data fetching block configured to generate p sampling pulses responsive to one or more timing pulses generated by the p shift registers provided with respect to the block, the p sampling pulses configured to fetch the multiphased video signal from the video signal lines into all data signal lines in the block;

the data signal line driving circuit performing:

a first driving in which the p shift registers in each block are driven sequentially to provide p sequential timing pulses and each sampling pulse in the block being responsive to a corresponding timing pulse such that the sampling pulses in the block are activated sequentially, and a second driving in which only one shift register in the block is driven to provide one timing pulse and all sampling pulses in the block are responsive to the one timing pulse such that all sampling pulses in the block are activated simultaneously.

4. The data signal line driving circuit as set forth in claim 3, wherein the data signal line driving circuit includes stopping means for stopping operation of the shift registers not required in driving the data signal lines when performing the second driving.

5. A data signal line driving circuit, which drives a plurality of data signal lines respectively so as to fetch a multiphased video signal having a plurality of color signals supplied via n, n>1, video signal lines into the data signal lines, wherein each video signal line includes a plurality of divisional video signal lines divided so as to respectively correspond to the color signals and each data signal line includes a corresponding plurality of divisional data signal lines, comprising:

m, m>1, data fetching blocks configured to receive a multiphased video signal supplied in parallel to the data fetching blocks by the video signal lines;

each data fetching block configured to fetch the multiphased video signal into n data line groups and each data line group including p, p>1, sequential data signal lines and driving p corresponding sequentially adjoining sections of a display;

a plurality of sampling switches, each sampling switch connecting a data signal line to a video signal line such that the p sequential data signal lines of each data line group are connected to the same video signal line and p sequential data signal lines are alternately connected to the same video signal line with an interval of another ((n−1)×p) data signal lines therebetween, the p sampling switches associated with a given data line group each configured to be responsive to a different sampling pulse;

p shift registers provided with respect to each data fetching block, the shift registers being connected between blocks such that the blocks are driven sequentially;

a sampling pulse generating section provided with respect to each data fetching block configured to generate p sampling pulses responsive to one or more timing pulses generated by the p shift registers provided with respect to the block, the p sampling pulses configured to fetch the multiphased video signal from the video signal lines into all data signal lines in the block;

the data signal line driving circuit performing:

a first driving in which the p shift registers in each block are driven sequentially to provide p sequential timing pulses and each sampling pulse in the block being responsive to a corresponding timing pulse such that the sampling pulses in the block are activated sequentially, and a second driving in which only one shift register in the block is driven to provide one timing pulse and all sampling pulses in the block are responsive to the one timing pulse such that all sampling pulses in the block are activated simultaneously.

6. The data signal line driving circuit as set forth in claim 5, wherein the data signal line driving circuit includes stopping means for stopping operation of the shift registers not required in driving the data signal lines when performing the second driving.

7. A display device, comprising:

a display panel which includes (i) a plurality of data signal lines, (ii) a plurality of scanning signal lines provided so as to cross the data signal lines, and (iii) pixels provided on intersections of the data signal lines and the scanning signal lines, a video signal for displaying an image being fetched from the data signal lines into the pixels in synchronism with a scanning signal supplied from the scanning signal lines, said video signal being retained and multiphased into a multiphased video signal supplied to the data signal lines via n, n>1, video signal lines;

a data signal line driving circuit for outputting the multiphased video signal to the data signal lines in synchronism with a predetermined timing signal; and a scanning signal line driving circuit for outputting the scanning signal to the scanning signal lines in synchronism with a predetermined timing signal; wherein the data signal line driving circuit is configured to drive said plurality of data signal lines respectively so as to fetch the multiphased video signal via said video signal lines into the data signal lines and includes:

m, m>1, data fetching blocks configured to receive the multiphased video signal supplied in parallel to the data fetching blocks by the video signal lines;

each data fetching block configured to fetch the multiphased video signal into n data line groups and each data line group including p, p>1, sequential data signal lines and driving p corresponding sequentially adjoining sections of a display;

a plurality of sampling switches, each sampling switch connecting a data signal line to a video signal line such that the p sequential data signal lines of each data line group are connected to the same video signal line and p sequential data signal lines are alternately connected to the same video signal line with an interval of another ((n−1)×p) data signal lines therebetween, the p sampling switches associated with a given data line group each configured to be responsive to a different sampling pulse;

p shift registers provided with respect to each data fetching block, the shift registers being connected between blocks such that the blocks are driven sequentially;

a sampling pulse generating section provided with respect to each data fetching block configured to generate p sampling pulses responsive to one or more timing pulses generated by the p shift registers provided with respect to the block, the p sampling pulses configured to fetch the multiphased video signal from the video signal lines into all data signal lines in the block;

the data signal line driving circuit performing:

a first driving in which the p shift registers in each block are driven sequentially to provide p sequential timing pulses and each sampling pulse in the block being responsive to a corresponding timing pulse such that the sampling pulses in the block are activated sequentially, and a second driving in which only one shift register in the block is driven to provide one timing pulse and all sampling pulses in the block are responsive to the one timing pulse such that all sampling pulses in the block are activated simultaneously.

8. The display device as set forth in claim 7, wherein the data signal line driving circuit, the scanning signal line driving circuit, and the pixels are formed on the same substrate.

9. A display device, comprising:

a display panel which includes (i) a plurality of data signal lines, (ii) a plurality of scanning signal lines provided so as to cross the data signal lines, and (iii) pixels provided on intersections of the data signal lines and the scanning signal lines, a video signal having a plurality of color signals for displaying an image being fetched from the data signal lines into the pixels in synchronism with a scanning signal supplied from the scanning signal lines, said video signal being retained and multiphased into a multiphased video signal supplied to the data signal lines via n, n>1, video signal lines; wherein each video signal line includes a plurality of divisional video signal lines divided so as to respectively correspond to the color signals and each data signal line includes a corresponding plurality of divisional data signal lines;

a data signal line driving circuit for outputting the multiphased video signal to the data signal lines in synchronism with a predetermined timing signal; and a scanning signal line driving circuit for outputting the scanning signal to the scanning signal lines in synchronism with a predetermined timing signal; wherein the data signal line driving circuit is configured to drive said plurality of data signal lines respectively so as to fetch the multiphased video signal via said video signal lines into the data signal lines and includes:

m, m>1, data fetching blocks configured to receive the multiphased video signal supplied in parallel to the data fetching blocks by the video signal lines;

each data fetching block configured to fetch the multiphased video signal into n data line groups and each data line group including p, p>1, sequential data signal lines and driving p corresponding sequentially adjoining sections of a display;

a plurality of sampling switches, each sampling switch connecting a data signal line to a video signal line such that the p sequential data signal lines of each data line group are connected to the same video signal line and p sequential data signal lines are alternately connected to the same video signal line with an interval of another $((n-1)\times p)$ data signal lines therebetween, the p sampling switches associated with a given data line group each configured to be responsive to a different sampling pulse;

p shift registers provided with respect to each data fetching block, the shift registers being connected between blocks such that the blocks are driven sequentially;

a sampling pulse generating section provided with respect to each data fetching block configured to generate p sampling pulses responsive to one or more timing pulses generated by the p shift registers provided with respect to the block, the p sampling pulses configured to fetch the multiphased video signal from the video signal lines into all data signal lines in the block;

the data signal line driving circuit performing:

a first driving in which the p shift registers in each block are driven sequentially to provide p sequential timing pulses and each sampling pulse in the block being responsive to a corresponding timing pulse such that the sampling pulses in the block are activated sequentially, and a second driving in which only one shift register in the block is driven to provide one timing pulse and all sampling pulses in the block are responsive to the one timing pulse such that all sampling pulses in the block are activated simultaneously.

10. The display device as set forth in claim 9, wherein the data signal line driving circuit, the scanning signal line driving circuit, and the pixels are formed on the same substrate.

* * * * *